US011649690B2

(12) United States Patent
Al-Othman et al.

(10) Patent No.: US 11,649,690 B2
(45) Date of Patent: May 16, 2023

(54) SOLID STATE LOST CIRCULATION MATERIAL

(71) Applicant: SAUDI ARABIAN OIL COMPANY, Dhahran (SA)

(72) Inventors: Mohammed Yousef Al-Othman, Dhahran (SA); Yousif M. Abuahmad, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 143 days.

(21) Appl. No.: 17/187,081

(22) Filed: Feb. 26, 2021

(65) Prior Publication Data

US 2022/0275699 A1 Sep. 1, 2022

(51) Int. Cl.
*E21B 33/12* (2006.01)
*E21B 33/124* (2006.01)
*E21B 33/127* (2006.01)

(52) U.S. Cl.
CPC ..... *E21B 33/1204* (2013.01); *E21B 33/124* (2013.01); *E21B 33/1277* (2013.01)

(58) Field of Classification Search
CPC ... E21B 33/1208; E21B 33/138; E21B 21/003
See application file for complete search history.

(56) References Cited

U.S. PATENT DOCUMENTS 2,836,555 A * 5/1958 Armentrout ..... C09K 8/516 507/112
4,460,052 A 7/1984 Gockel
6,630,429 B1 10/2003 Cremeans et al.
6,988,557 B2 1/2006 Whanger et al.
7,703,539 B2 4/2010 Levy
10,584,564 B2 3/2020 Sherman
2016/0024897 A1* 1/2016 Greci ..... E21B 43/108 166/227
2016/0160106 A1* 6/2016 Jamison ..... C09K 8/035 507/112
2018/0087350 A1* 3/2018 Sherman ..... E21B 43/086
2021/0108123 A1* 4/2021 Jamison ..... C09K 8/518

FOREIGN PATENT DOCUMENTS

CA 2457294 C 7/2007

* cited by examiner

*Primary Examiner* — David Carroll
(74) *Attorney, Agent, or Firm* — Osha Bergman Watanabe & Burton LLP

(57) ABSTRACT

Provided is a solid-state lost circulation apparatus that may comprise a drillable tube with one or more fluid ports, an expandable layer, and an isolation layer. Upon introduction of the expandable layer to an activation agent through one or more fluid ports, the expandable layer may activate, expand, and harden into a hardened and expanded expandable layer, while rupturing the isolation layer. Further provided is a lost circulation assembly system that may include a drill pipe and a solid-state lost circulation apparatus. Further provided is a method of mitigating a lost circulation zone with a lost circulation assembly system. Further provided is a solid plug that may be positioned in a wellbore and may include a hardened and expanded expandable layer and a drillable tube. Further provided is a remnant of a solid plug that may form a fluid-tight seal across a face of a lost circulation zone.

4 Claims, 12 Drawing Sheets

SOLID STATE LOST CIRCULATION MATERIAL

BACKGROUND

Hydrocarbon development operations may include subterranean well drilling. During drilling, a wellbore may pass through a lost circulation zone. The lost circulation zone may include induced or natural fractures, cavernous regions, or areas with increased permeability compared to areas with solid formation materials. Drilling mud and other circulation fluids that are supposed to return to the surface might flow into the lost circulation zone. When they enter this zone, they become irretrievable. Thus, lost circulation is a situation where the flow of the drilling fluid back uphole toward the surface is reduced or absent.

The spectrum of lost circulation zone losses may range from minor to severe types. In other words, loss in these zones may range from a small seepage loss to a total loss.

When such drilling fluid losses occur, lost circulation materials may be introduced into the drilling fluid from the surface. The lost circulation materials circulate downhole to plug and seal the exposed formation where losses are occurring. Once the treated formation is sealed with an acceptable level of fluid loss, drilling operations may resume.

SUMMARY

This summary introduces a selection of concepts that are further described in the Detailed Description. This summary is not intended to identify key or essential features of the claimed subject matter, nor is it intended to be used as an aid in limiting the scope of the claimed subject matter.

In one aspect, one or more embodiments relate to a solid-state lost circulation apparatus. The apparatus may comprise a drillable tube comprising a drillable material configured with an interior surface, an exterior surface, a distal end, a proximal end, and a longitudinal length. Along the longitudinal length of the drillable tube, one or more fluid ports through the drillable tube may be defined. The drillable tube may include an expandable layer comprising an expandable material that is a drillable material, coupled to the exterior surface of the drillable tube for a portion of or the full extent of the longitudinal length. The expandable material may have an interior surface and an exterior surface, and may be configured such that upon introduction to an activation agent the expandable layer activates, expands, and hardens into a hardened and expanded expandable layer. The apparatus may include an isolation layer comprising a material that is non-reactive to the activation agent and that is a drillable material, having an interior surface and an exterior surface, coupled to the exterior surface of the expandable layer such that the exterior surface of the expandable layer is physically and chemically isolated from introduction to the activation agent. The isolation layer may be configured to rupture upon a sufficient force being introduced to the interior surface by an expanding expandable layer.

In another aspect, one or more embodiments relate to the solid-state lost circulation apparatus where the activation agent may include water.

In another aspect, one or more embodiments relate to the solid-state lost circulation apparatus where the isolation layer may be non-reactive to a water-based drilling fluid.

In another aspect, one or more embodiments relate to the solid-state lost circulation apparatus that may further comprise a downhole connector coupled to the distal end of the drillable tube and that may be sealed to prevent fluid flow through the downhole connector from the drillable tube.

In another aspect, one or more embodiments relate to a lost circulation assembly system that may comprise a drill pipe and a solid-state lost circulation apparatus coupled downstring of the drill pipe.

In another aspect, one or more embodiments relate to the lost circulation assembly system that may further comprise a bypass tool.

In another aspect, one or more embodiments relate to the lost circulation assembly system where the bypass tool may be configured to have a closed mode, a bypass mode, and an open mode of operation.

In another aspect, one or more embodiments relate to a method of mitigating a lost circulation zone. The method may comprise introducing a lost circulation assembly system into a wellbore such that a solid-state lost circulation apparatus is positioned adjacent to the lost circulation zone.

In another aspect, one or more embodiments relate to the method of mitigating a lost circulation zone where the activation agent may be present in the wellbore before introduction of the apparatus.

In another aspect, one or more embodiments relates to the method of mitigating a lost circulation zone that may further comprise introducing an activation agent into an interior of the solid-state lost circulation apparatus such that an expandable layer on an exterior surface of a drillable tube of the apparatus is activated. The method may further include maintaining wellbore conditions and the system such that the expandable layer expands and hardens to form part of a solid plug, where the solid plug is positioned adjacent to the lost circulation zone and provides a fluid-tight seal across a face of the lost circulation zone. Upon activation, the expandable layer may expand from a pre-activated state into a hardened and expanded expandable layer such that the hardened and expanded expandable layer contacts a wellbore wall in and around the face of the lost circulation zone. In the method, the solid plug may separate a portion of the wellbore uphole of the solid plug from a portion of the wellbore downhole of the solid plug.

In another aspect, one or more embodiments relate to the method of mitigating a lost circulation zone that may further comprise introducing the activation agent into an annular space of the wellbore before introducing the activation agent into the interior of the apparatus.

In another aspect, one or more embodiments relate to the method of mitigating a lost circulation zone where introducing the activation agent into an annular space of the wellbore may include changing the mode of operation of an upstring bypass tool.

In another aspect, one or more embodiments relate to the method of mitigating a lost circulation zone where introducing the activation agent into the interior of the solid-state lost circulation apparatus may include changing a mode of operation of an upstring bypass tool.

In another aspect, one or more embodiments relate to the method of mitigating a lost circulation zone where introducing the activation agent into the interior of the solid-state lost circulation apparatus may include introducing wellbore fluid into the interior of the apparatus from the wellbore.

In another aspect, one or more embodiments relate to the method of mitigating a lost circulation zone where the solid plug may permits fluidic communication between the portion of the wellbore uphole of the solid plug and the portion of the wellbore downhole of the solid plug through the drillable tube.

In another aspect, one or more embodiments relate to the method of mitigating a lost circulation zone that may further comprise drilling through a solid plug such that a remnant of the solid plug is positioned adjacent to the lost circulation zone and provides a fluid-tight seal across a face of the lost circulation zone. The remnant may be configured in a ring-like or a sleeve shaped seal.

In a further aspect, one or more embodiments relate to a solid plug positioned in a wellbore. The solid plug may comprise a hardened and expanded expandable layer and a drillable tube, where the solid plug may form a fluid-tight seal across a face of a lost circulation zone, and where the hardened and expanded expandable layer may be a resultant of a reaction between an activation agent and an expandable layer.

In yet another aspect, one or more embodiments relate to a remnant of a solid plug positioned in a wellbore. The remnant may comprise a hardened and expanded expandable layer, where the remnant may form a fluid-tight seal across a face of a lost circulation zone and may be configured in a ring-like or a sleeve shaped seal. The hardened and expanded expandable layer may be a resultant of a reaction between an activation agent and an expandable layer, and the ring-like or sleeve shaped seal configuration may be a resultant of drilling through the solid plug.

Other aspects and advantages of the claimed subject matter will be apparent from the following description and the appended claims.

BRIEF DESCRIPTION OF DRAWINGS

This section describes specific embodiments in detail with reference to the accompanying figures. Where the figures include like elements between them, they are denoted by like reference numerals. They may be differentiated by letters appended to reference numerals. The use of the prime or "'" mark with a numeral indicates a like element in a different state of operation or condition than as previously referenced; however, other aspects remain the same.

Figure 1:
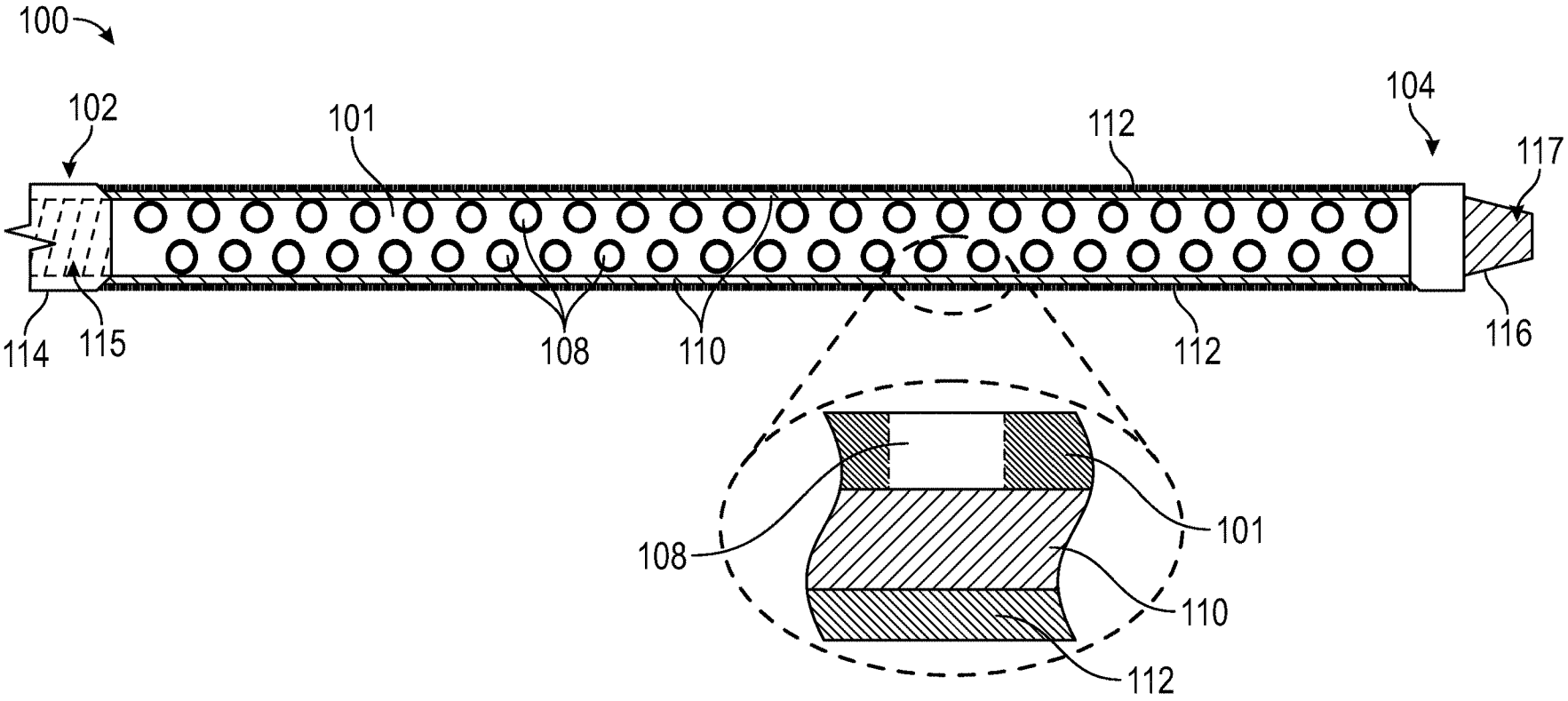
FIG. 1 depicts a partial cutaway view of the solid-state lost circulation apparatus in a pre-activated state, per one or more embodiments.

Typically, down is toward or at the bottom and up is toward or at the top of the figure. "Up" and "down" are oriented relative to a local vertical direction. However, in the oil and gas industry, one or more activity takes place in deviated or horizontal wells. Therefore, one or more figure may represent an activity in deviated or horizontal wellbore configuration.

"Uphole" may refer to objects, units, or processes that are positioned closer to the surface entry in a wellbore. "Downhole" may refer to objects, units, or processes that are positioned farther from the surface entry in a wellbore. The terms "upstring" and "downstring" may relate in a similar way to a position along a string of tools or pipe while positioned in a wellbore.

DETAILED DESCRIPTION

In the following Detailed Description, numerous details provide a thorough understanding of the disclosure. However, one of ordinary skill in the art will find that the disclosure may be practiced without these details. Moreover, one or more well-known features are briefly detailed to avoid unnecessarily complicating the description.

When an ordinal number appears in the application (for example, first, second, third), it simply distinguishes between elements. For example, a first element is distinct from a second element. Unless otherwise noted, the first element may include more than one element and it may either precede or succeed a second element.

Conventional techniques to mitigate lost circulation may introduce a lost circulation material into a circulation fluid. The idea is to apply a lost circulation material that will flow into the lost circulation zone while plugging up its face. A face of a lost circulation zone is the interface between the lost circulation zone and the wellbore along the wellbore wall.

Two or more inadequacies arise when the lost circulation material reaches a lost circulation zone. First, an initial attempt to mitigate the lost circulation zone may prove ineffective with conventional techniques. Second, conventional techniques may fail to mitigate the lost circulation zone even with multiple attempts.

Conventional lost circulation techniques often include determining and calibrating the particular class and size of lost circulation zone. Then, a lost circulation material is chosen so it performs well with that particular lost circulation zone.

Instead of lost circulation material, other conventional techniques may introduce cement downhole. Ideally a cement plug forms to mitigate the lost circulation zone. However, conventional cementing and plugging techniques may result in the inadequacies mentioned previously. Additionally, waiting for cement to set takes time. This waiting time may put the wellbore or its operators at risk.

One or more embodiments of the present disclosure include an apparatus that seals a lost circulation zone. One or more embodiments of the present disclosure include a system useful in sealing a lost circulation zone using the apparatus. One or more embodiments of the present disclosure include a method of mitigating a lost circulation zone.

The apparatus that seals a lost circulation zone is a solid-state lost circulation apparatus in one or more embodiments. The "solid-state lost circulation apparatus" is a singular apparatus configured to mitigate a lost circulation zone.

Advantageously, a single solid-state lost circulation apparatus may mitigate various types and classes of lost circulation zones. What is more, an operator can go without picking and choosing what conventional lost circulation material fits properly.

The solid-state lost circulation apparatus includes components that made from drillable materials. This means that the apparatus itself is drillable.

A "drillable material", such as a drillable tube or coupling, is a material that may be readily drilled through using commonly available drilling technology. Common drilling technology is known in the art. It includes, but is not limited to, drilling components, like drill bits, and drilling techniques, like drilling through a formation or making a borehole. "Readily drilled through" means drilling through one or more object using conventional drilling techniques.

The apparatus includes an expandable layer. The expandable layer may expand and then harden to form a hardened and expanded expandable layer. This occurs after exposure to an activation agent. The combination of the hardened and expanded expandable layer and the drillable tube together form a solid plug. The expandable layer and the drillable tube are parts of the solid-state lost circulation apparatus.

Once the solid plug forms, it may prevent the flow of fluid between the lost circulation zone and the wellbore. The solid plug may form a fluid-tight seal. The solid plug may prevent the fluid and objects from moving between uphole and downhole portions of the wellbore. The solid plug may be readily drilled through.

The apparatus may also include an isolation layer. The isolation layer protects the exterior of the expandable layer. The isolation layer may prevent the expandable layer from contacting the activation agent or suffering physical damage. The isolation layer isolates the expandable layer from fluid and objects in the annulus.

One or more embodiments of the disclosure relate to a lost circulation assembly system. A "lost circulation assembly system" means a system that includes a solid-state lost circulation apparatus.

In one or more embodiments, a method of using the lost circulation apparatus mitigates a lost circulation zone. The method may include introducing the solid-state lost circulation apparatus into the wellbore. The method may include positioning the apparatus next to the lost circulation zone. The method may include introducing an activation agent into the interior of the apparatus. The activation agent is configured to interact with the expandable layer.

In one or more embodiments, the method includes maintaining the wellbore. This allows the expandable layer to expand up to and contact the wellbore wall. The interaction between the expanding expandable later and the wellbore wall may form a fluid-tight seal.

In one or more embodiments, maintaining the wellbore allows the expanded expandable layer to harden. This forms the hardened and expanded expandable layer. The hardened and expanded expandable layer, together with one or more components of the apparatus forms a solid plug. The solid plug is suspended, embedded into the wellbore wall at the lost circulation zone. The solid plug presses against the wellbore wall, taking its shape while immovable until drilling resumes.

The method may further include monitoring fluid losses and pressure.

The method may further include drilling through the solid plug. Drilling through the solid plug may re-establish fluidic communication between the uphole and the downhole portion of the wellbore, where the movement of fluid between the two portions was previously blocked by the solid plug.

Once drilled through, a remainder of the solid plug is left connected to the wellbore wall. This element that remains, plugging up the lost circulation zone, is referred to as the "remainder of the solid plug."

The remainder of the solid plug may be configured as a ring-like or a sleeve shaped seal. The seal attaches to the wellbore wall, adhering to the face of the lost circulation zone. The remainder of the solid plug maintains a fluid-tight seal over the face of the lost circulation zone. The remainder of the solid plug stays intact even in the presence of tools, tool movement, and fluid flow. This means the integrity of the remainder of the solid plug is unaffected by further activity in the wellbore.

FIG. 1 depicts a partial cutaway view of the solid-state lost circulation apparatus in a pre-activated state. "Pre-activated state" means that the expandable material has not been exposed to the activation agent.

In FIG. 1, apparatus 100 includes a drillable tube 101. Drillable tube 101 is a hollow tube having an interior surface that defines an interior space, an exterior surface, a proximal end 102 (the uphole end), a distal end 104 (the downhole end), and a longitudinal length from end to end. Along at least a portion of the longitudinal length, the drillable tube 101 defines fluid ports 108. The fluid ports allow fluid access between the interior of the drillable tube and the exterior of the drillable tube.

On a proximal end of the drillable tube, an uphole connector couples or connects to the drillable tube. As shown in FIG. 1, uphole connector 114 may have internal threads 115 that permit the apparatus 100 to couple or connect to other components. Here, other components may include, but are not limited to, subassemblies ("subs"), drill collars, and drill pipe, with standard pipe fittings and connections, such as pipe threads. In addition, uphole connector may allow fluid flow from upstring of apparatus into drillable tube.

A downhole connector couples or connects to the distal end of the drillable tube. As shown in FIG. 1, downhole connector 116 may have external threads 117 that permit the apparatus 100 to couple or connect to other components. Other components may include subs, drill collars, and drill pipe. Another component may include a second solid-state lost circulation apparatus using standard pipe fittings and connections. In one or more embodiments, a downhole connector may allow fluid flow from drillable tube. The downhole connector may be closed or sealed in some instances. When sealed, the downhole connector keeps fluid flow inside the drillable tube and inaccessible to the annular space.

An expandable layer is coupled or connected to one or more portion of the exterior surface of the drillable tube. In FIG. 1, the expandable layer 110 runs along the longitudinal length of the drillable tube 101. The expandable layer may simply cover a portion of the longitudinal length or a portion of the circumference of the drillable tube. In one or more embodiments, the expandable layer is configured where an interior surface of the expandable layer overlaps one or more fluid ports of the drillable tube. In other instances, the expandable layer may cover the drillable tube without covering the ports.

Coupled or connected to the exterior surface of the expandable layer is an isolation layer. The isolation layer 112 as shown in FIG. 1 covers the exterior surface of the expandable layer 110. The expandable layer serves as a barrier to isolate the exterior surface of the expandable layer from activation agent.

An inset of FIG. 1 shows added detail about the relationship between the drillable tube 101, the fluid ports 108, the expandable layer 110, and the isolation layer 112. As depicted, a fluid, including an activation agent, may flow through the interior of the apparatus to the expandable layer 110 via fluid ports 108. Isolation layer 112 prevents a fluid from contacting expandable layer 110 from the exterior of the apparatus 100.

Figure 2A:
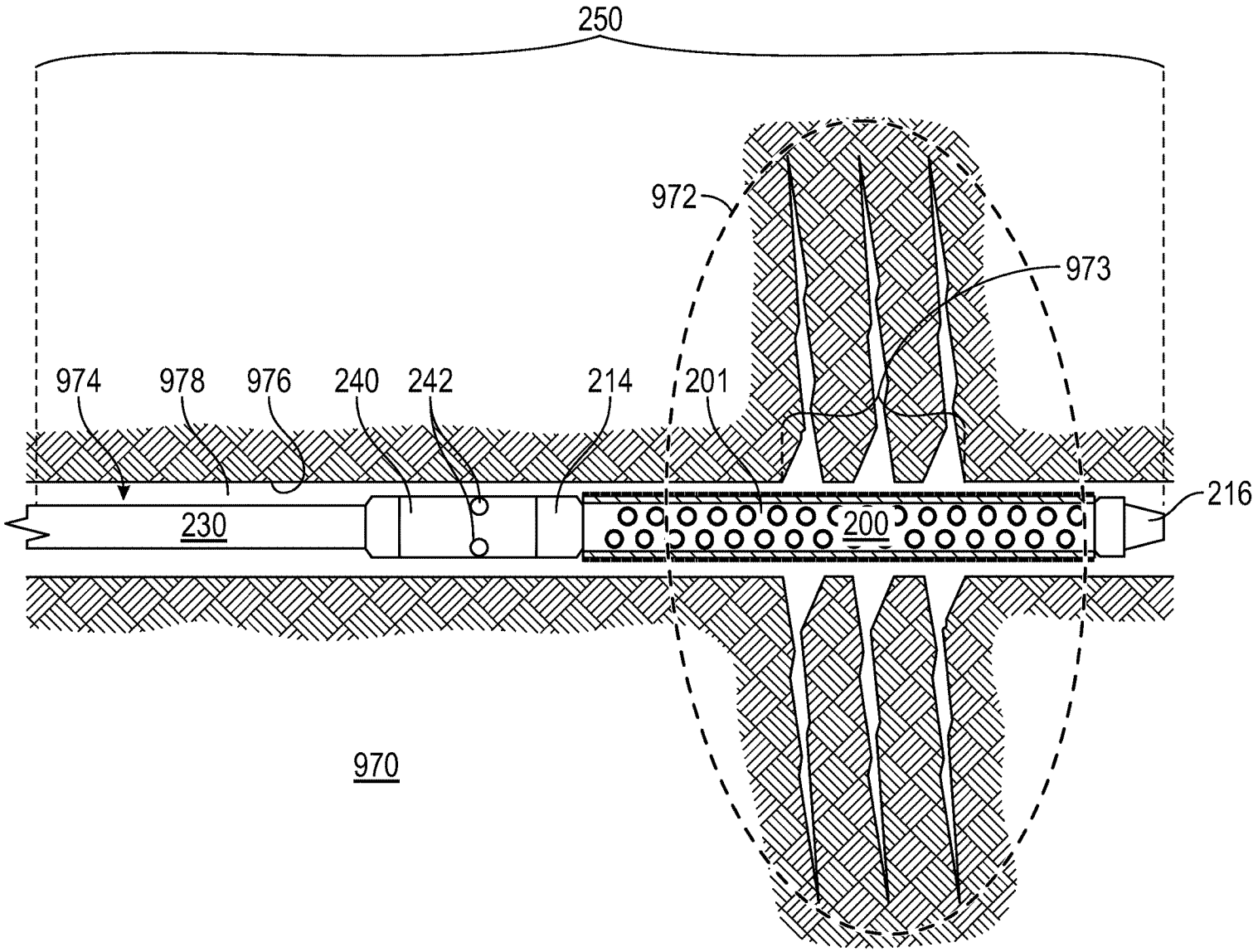
FIG. 2A shows the lost circulation assembly system (including the solid-state lost circulation apparatus) positioned in a wellbore adjacent a lost circulation zone, per one or more embodiments.

FIG. 2A shows the lost circulation assembly system positioned in a wellbore adjacent a lost circulation zone. The system includes the solid-state lost circulation apparatus. FIG. 2A shows a lost circulation assembly system 250 introduced into the wellbore 974. A fluidic communication may be seen between lost circulation zone 972 (encircled) and a wellbore 974 through the lost circulation zone face 973. A wellbore wall 976 defines the wellbore 974 that traverses a reservoir 970. Between the lost circulation assembly system 250 and the wellbore wall 976 is an annular space 978 in the wellbore 974.

FIG. 2A shows lost circulation assembly system 250 couples to a drill pipe 230 that extends uphole towards the surface (not shown). A bypass tool 240 couples downstring of drill pipe 230. Further, FIG. 2A shows fluid flow conduits 242 in the bypass tool 240. The bypass tool is configured to selectively direct fluid flow, such as into the annular space and into the apparatus. Fluid may also flow into other areas of the wellbore.

FIG. 2A also shows solid-state lost circulation apparatus 200 (in partial reveal). Apparatus 200 is similar to apparatus 100 of FIG. 1. Apparatus 200 is in a pre-activated state. The apparatus 200 is positioned in the wellbore 974 adjacent to the lost circulation zone 972. As depicted, the longitudinal length of the drillable tube 201 is longer than the longitudinal length of the lost circulation zone face 973 along wellbore wall 976. Apparatus 200 couples to the downstring side of bypass tool 240 via uphole connector 214. In this depiction, the downhole connector 216 is closed within apparatus 200.

Figure 2B:
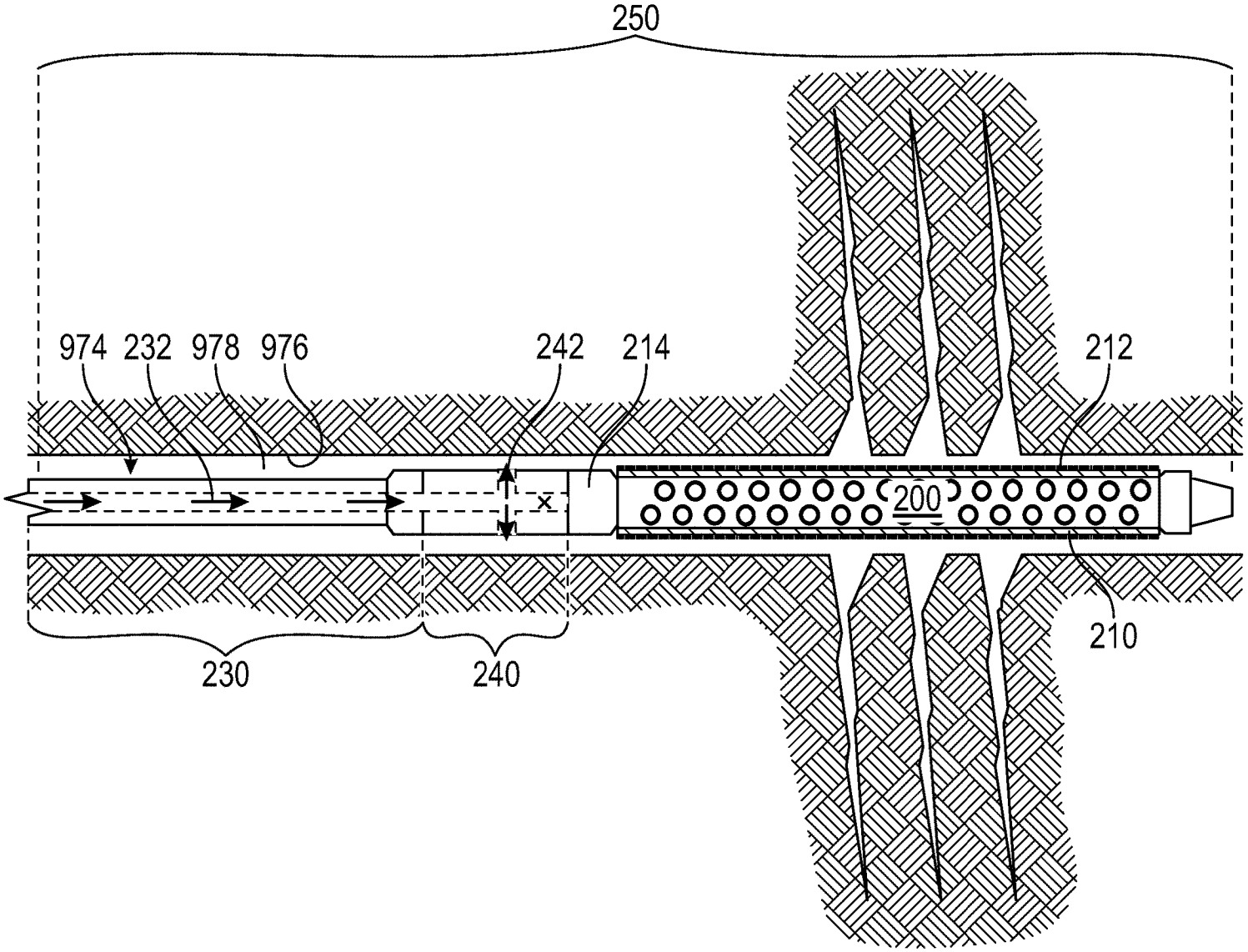
FIG. 2B shows the system in a pre-activated state, per one or more embodiments.

FIG. 2B shows an apparatus in a pre-activated state. Fluid flow, represented by arrows, navigates through a portion of the lost circulation assembly system 250 (shown in partial relief). The fluid flows downstring along the fluid flow path 232. Fluid flows through drill pipe 230 and into bypass tool 240. The bypass tool 240 is shown in a bypass mode of operation, which directs fluid flow through fluid flow conduits 242 and into the annular space 978. In this mode of operation, fluid flow is selectively prevented from entering apparatus 200 or contacting the expandable layer 210 by the bypass tool 240 (represented by an "x").

When fluid is prevented from entering the interior of the apparatus, the fluid is unable to contact the expandable layer. In addition, the fluid in the annular space is unable to contact the expandable layer through the isolation layer. The isolation layer physically and chemically prevents this interaction. This also means the expandable layer is isolated from contacting the activation agent whether it is present in the annulus or the fluid flowing through the bypass tool.

Figure 2C:
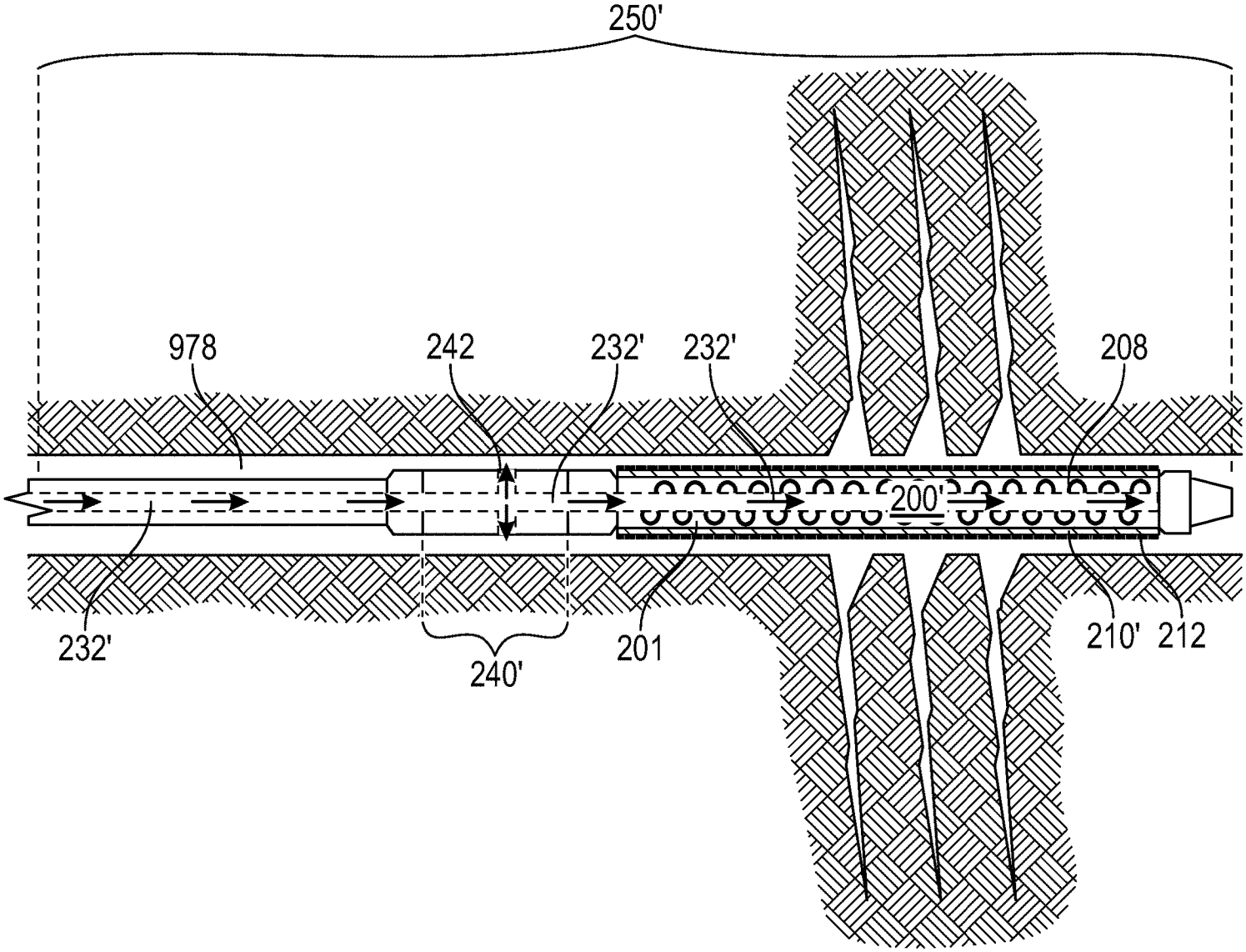
FIG. 2C shows the activated system, per one or more embodiments.

FIG. 2C shows the system being activated. In this "active state", the fluid makes contact with the expandable material of the solid-state lost circulation apparatus. In this instance, the fluid also contains the activation agent for the expandable layer. The active state system 250' (shown in partial reveal) has fluid flowing downstring along fluid flow path 232'. Fluid flow path 232' has been modified from a previous state by a change to the operation of the bypass tool 240'. The bypass tool 240', now in open mode of operation, permits fluid flow downstring into activated apparatus 200'. Fluid continues to flow into the annular space 978.

The change to the fluid flow path allows the fluid and activation agent to be introduced into the interior of the drillable tube of the solid-state lost circulation apparatus. Inside, the fluid passes through the one or more fluid port and interacts with the expandable layer. Upon introduction of the activation agent, the solid-state lost circulation apparatus becomes an activated apparatus, and the system becomes an active system.

As shown in FIG. 2C, the activated apparatus 200' includes activated expandable layer 210'. Although activated, the activated expandable layer 210' has not begun to physically expand. The isolation layer 212 remains intact. This means that any activation agent present in the fluid in the annular space is still isolated from the activated expandable layer.

Figure 2D:
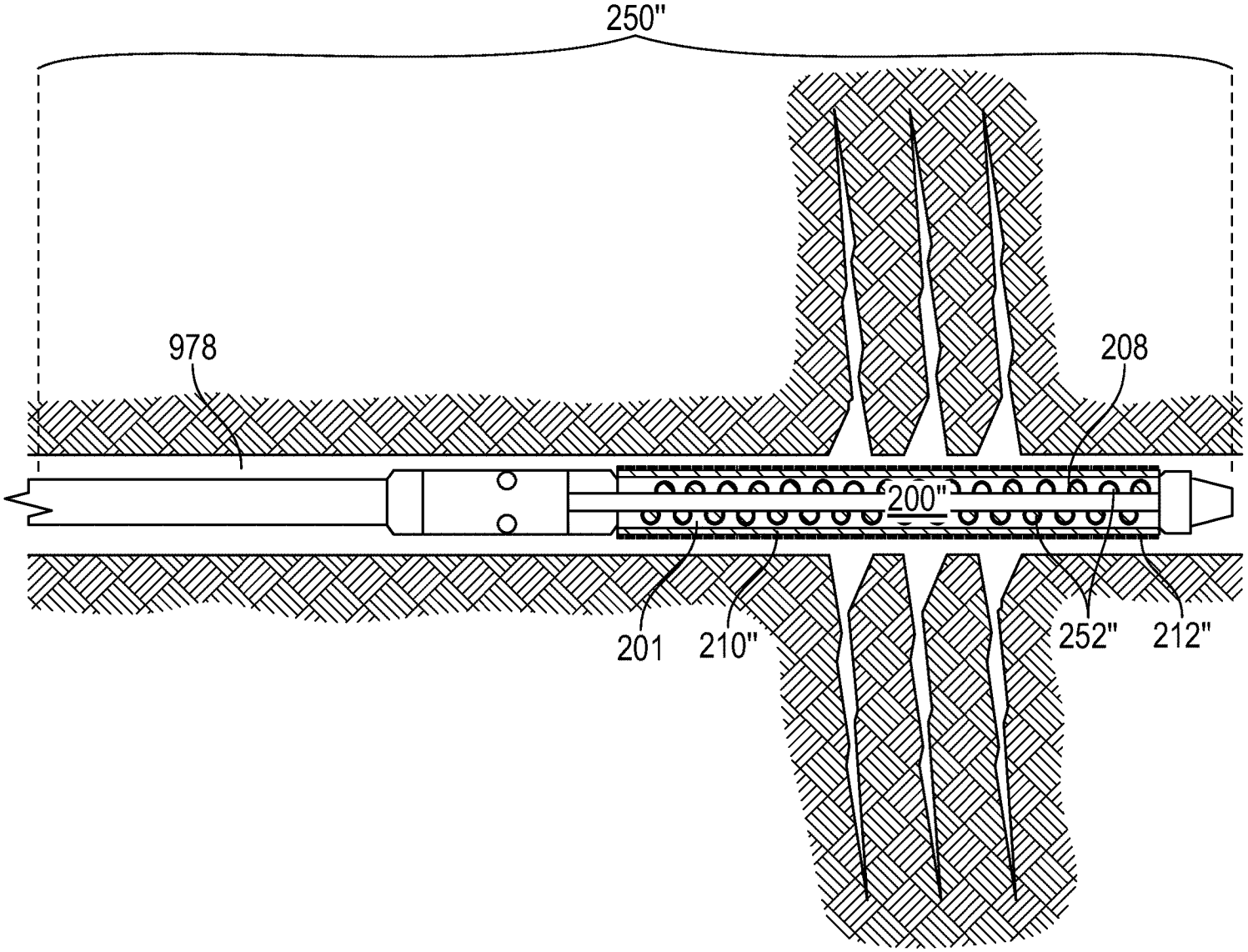
FIG. 2D shows the system in an active state where an expandable layer of the apparatus begins to expand, per one or more embodiments.

FIG. 2D shows the system in an active state where an expandable layer of the apparatus has begun to expand. System 250" includes an expanding expandable layer 210" on the exterior surface of activated apparatus 200" (shown in partial reveal). The expanding expandable layer 210" expands outward from the outer surface of the drillable tube 201. The expanding expandable layer 210" also expands inward into the interior of the drillable tube 201 through fluid ports 208 (such as portion 252" of expanding expandable layer 210").

As shown in FIG. 2D, isolation layer 212" remains intact. However, isolation layer is receiving an amount of expansion force from the expanding expandable layer. When receiving expansion force, the isolation layer may begin to physically deform. This may include stretching or warping of the isolation layer from its original configuration. In other instances, the isolation layer may disconnect or decouple from the exterior surface of the expanding expandable layer but remain intact before breaking.

Figure 2E:
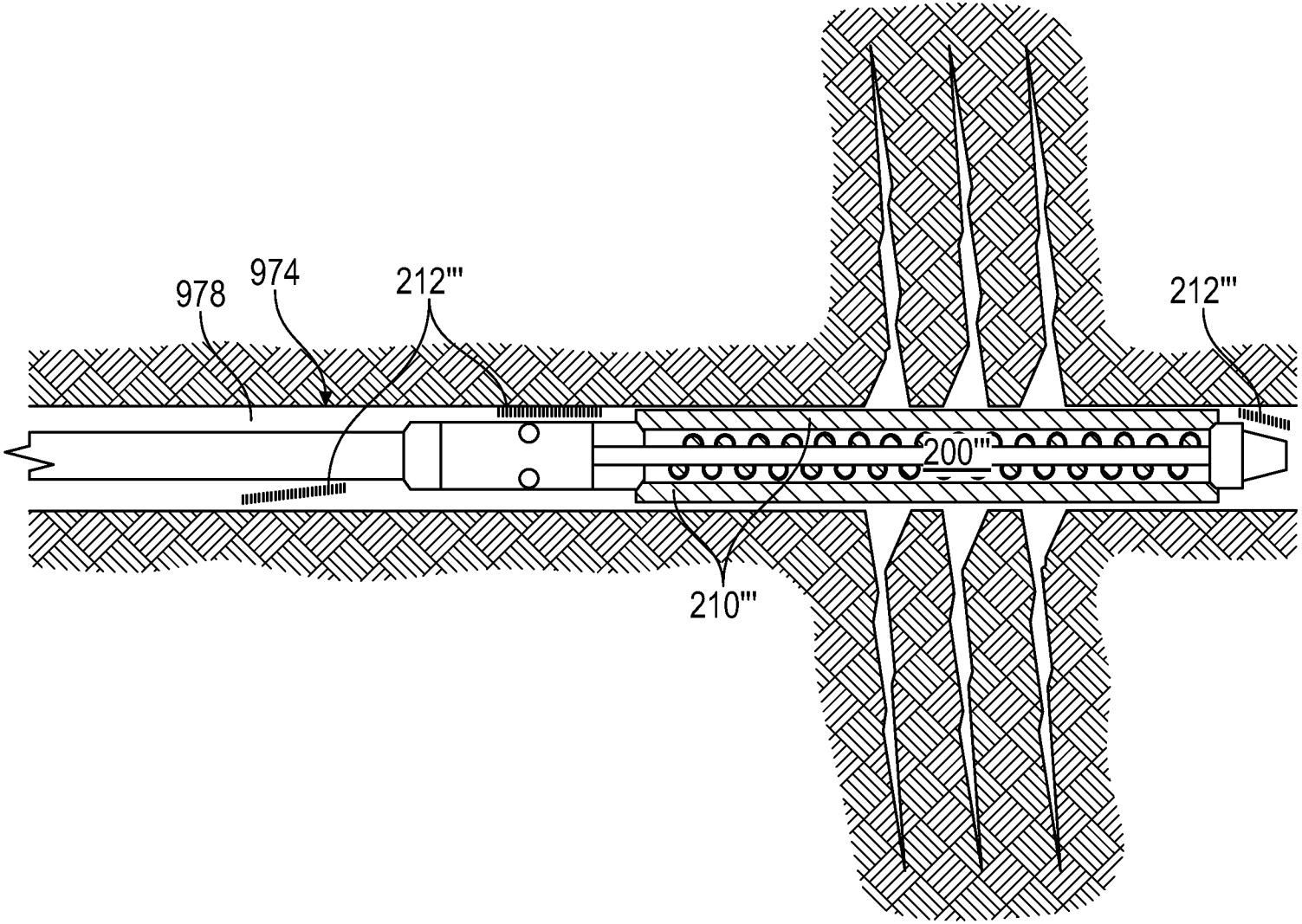
FIG. 2E shows the system in an active state where an isolation layer of the apparatus is ruptured, per one or more embodiments.

FIG. 2E shows the system in an active state with a ruptured isolation layer. The integrity of the isolation layer 212'" in FIG. 2E is compromised by expanding expandable layer 210'", which has expanded further into the wellbore. This rupture occurs when the expanding expandable layer provides sufficient force to break the isolation layer. The now-broken isolation layer 212'" is in fragments floating freely in the annular space 978. In some instances, the broken isolation layer or portions thereof no longer couple or connect to the expanding expandable layer. The expanding expandable layer may now continue to expand without restriction by the isolation layer.

Upon rupturing the isolation layer, activation agent present in the annular space may contact and interact with the exterior surface of the expanding expandable layer. This interaction may activate previously non-activated portions of the expandable material. Contact with activation agent in the annular space may further accelerate expansion and hardening of the expanding expandable layer.

Figure 2F:
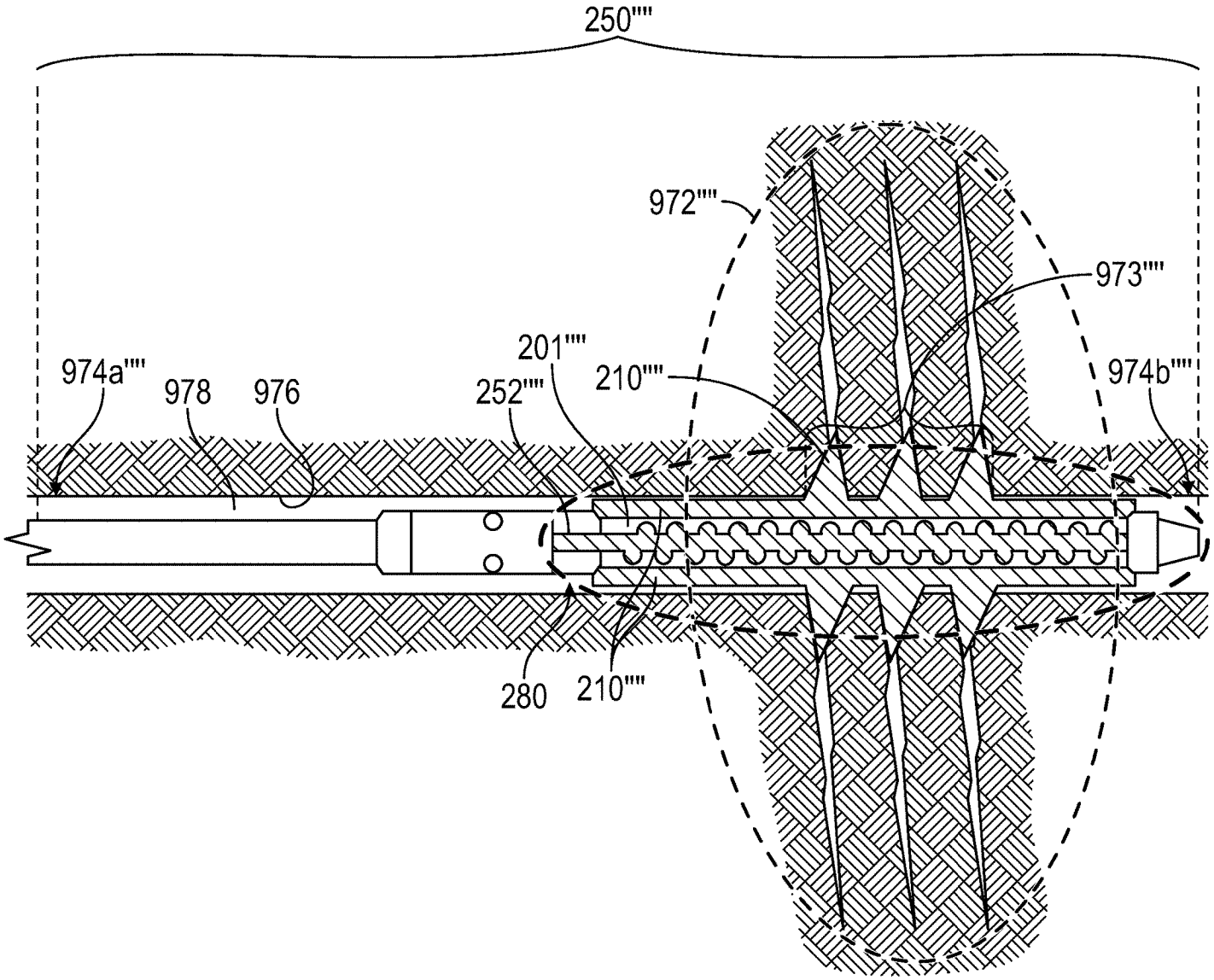
FIG. 2F shows the system in an active state where the apparatus has formed a solid plug to seal the lost circulation zone, per one or more embodiments.

FIG. 2F shows the system in an active state where the apparatus has formed a solid plug to seal the lost circulation zone. Hardened and expanded expandable layer 210"" of the apparatus 200"" is shown occupying the annular space 978 around drillable tube 201"" (shown in partial relief). Hardened and expanded expandable layer has expanded such that it contacts the wellbore wall. Hardened and expanded expandable layer exerts pressure on the wellbore wall, adhering itself to the wellbore. This anchors the position of the apparatus in the wellbore.

FIG. 2F shows full expansion of the expandable layer. A portion of the hardened and expanded expandable layer 210"" is shown pressing against the face 973"" of the lost circulation zone 972"". The pressure of the expanding expandable layer creates a fluid-tight seal between the wellbore and the face. Fluid flow is blocked between the lost circulation zone and the wellbore. In the instance shown in FIG. 2F, the hardened and expanded expandable layer 210"" intrudes into the lost circulation zone 972"". This intrusion is part of the fluid-tight seal in and around the face. The intrusion is just an extension of the hardened and expanded expandable layer and improves the fluid-tight seal as a type of reinforcement. The intrusions may further anchor the solid plug in the wellbore and to the wellbore wall.

The expansion and hardening of the expanded expandable layer may also fluidly isolate portions of the wellbore from one another. As shown in FIG. 2F, the portion of the wellbore uphole 974*a*"" of the hardened and expanded expandable layer 210"" is fluidly isolated from the portion of the wellbore downhole 974*b*"" of the hardened and expanded expandable layer 210"". In addition, a portion 252"" of hardened and expanded expandable layer 210"" expands into and hardens within the interior of the drillable tube 201"". This seals off the interior of the drillable tube from fluid flow.

As shown in FIG. 2F, the combination of the hardened and expanded expandable layer 210"" and the drillable tube 201"" forms a solid plug 280 (dot-dash ellipse). The solid plug creates one or more fluid-tight seals in the wellbore, as previously described.

Figure 3A:
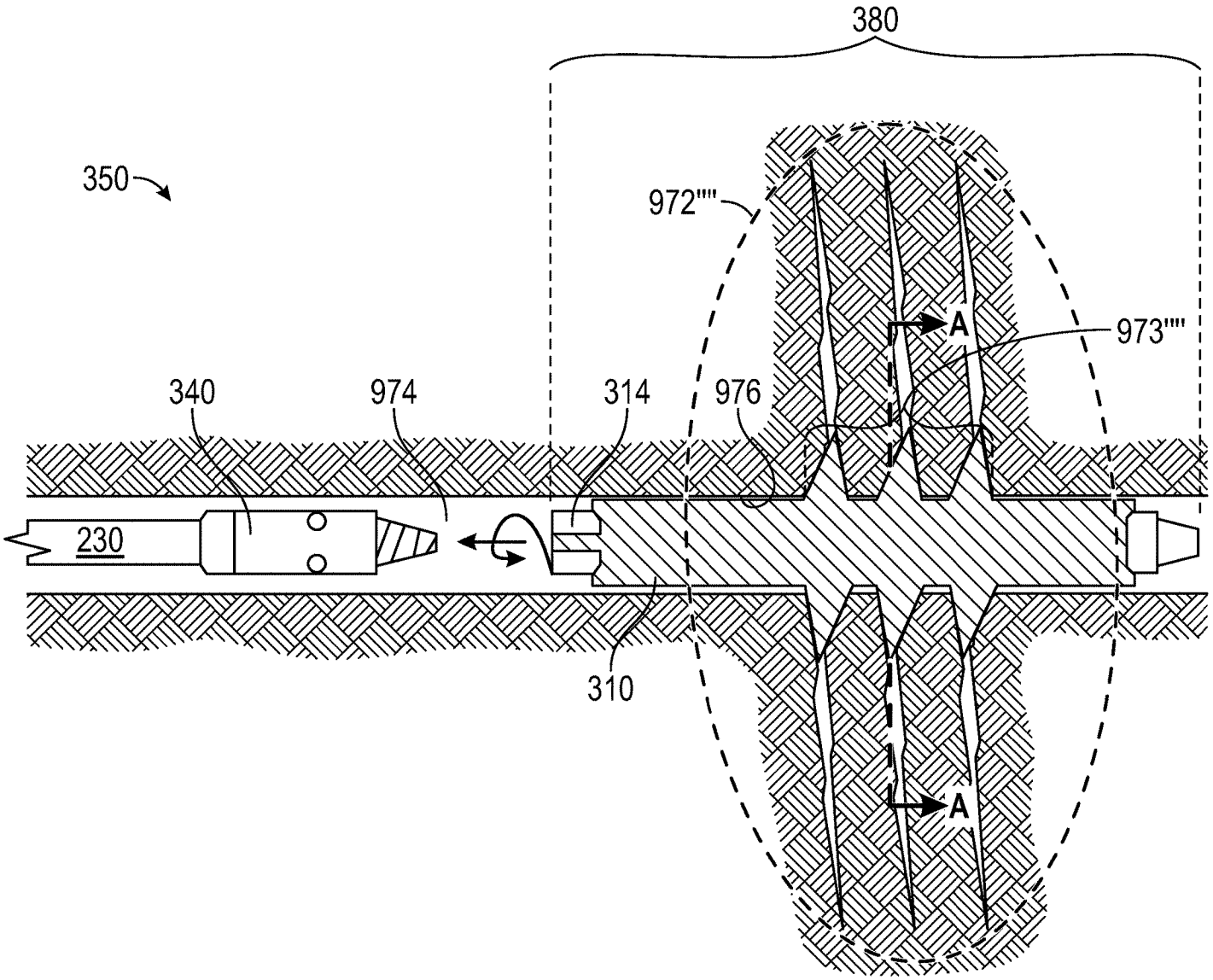
FIG. 3A shows the solid plug being abandoned in a wellbore, per one or more embodiments.

FIG. 3A shows the process of abandoning a solid plug in a wellbore. Lost circulation assembly system 350 is equivalent to system 250"" as previously described, but it is now shown being separated. Because the solid plug 380 presses against the wellbore wall 976 and seals the face 973"", the remainder of the lost circulation assembly system 350 may be disconnected from the solid plug 380. The system may disconnect (curved arrow) between bypass tool 340 and the solid plug 380 at uphole connector 314. This breaks apart system into its base components. The drill pipe and bypass tool may be withdrawn (straight arrow) from the wellbore. After removing the drill pipe and bypass tool, the wellbore and lost circulation zone remain fluidly sealed by the solid plug.

Figure 3B:
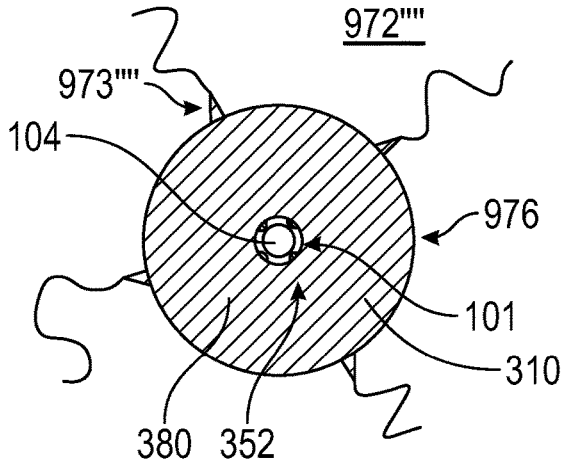
FIGS. 3B to 3E show center cut views of various solid plugs, per one or more embodiments.

FIGS. 3B to 3E show four variations of a solid plug. FIGS. 3B to 3E show a reveal along the bifurcation line marked "AA" in FIG. 3A. In these depictions, the viewer is looking at a cross section of a solid plug as if uphole from the solid plug looking downhole. FIG. 3B is similar to the configuration described in FIGS. 2A to 2F and FIG. 3A. The lost circulation zone is mitigated at the face along the solid plug. Hardened and expanded expandable layer 310 presses up against the wellbore wall. A portion 352 of hardened and expanded expandable layer intrudes into the interior of the drillable tube 101 through flow ports (not shown for clarity). From this view, distal end 104 is closed or sealed. In this configuration, fluid is isolated from moving past the solid plug downhole.

Figure 3C:
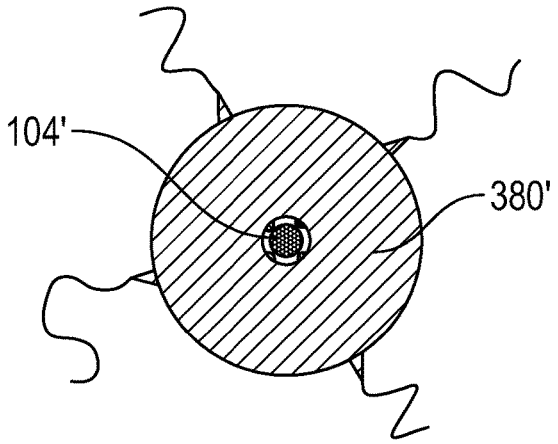
Figure 3D:
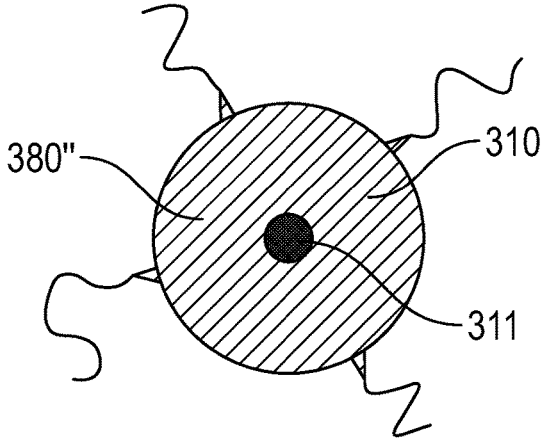
Figure 3E:
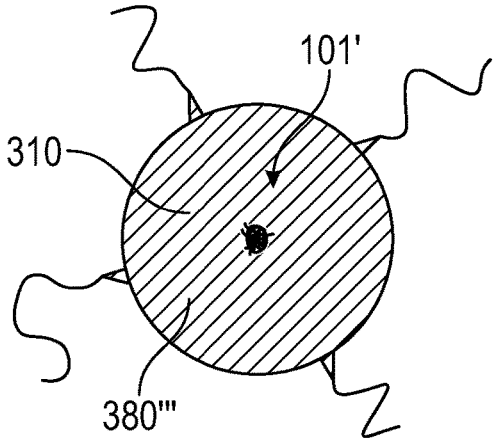

The solid plug 380' of FIG. 3C is shown having an open distal end 104', which may allow fluid circulation and fluidic communication between uphole and downhole of the solid plug 380'. FIG. 3D shows a solid plug 380" with an internal hardened and expanded expandable layer 311 that is different than the hardened and expanded expandable layer 310. Such an apparatus may also fluidly seal the wellbore from uphole and downhole of the solid plug. Finally, FIG. 3E shows solid plug 380''' including the hardened and expanded expandable layer 311 and a crushed drillable tube 101'. One may envision that the force of expansion during formation of the solid plug may deform, collapse, or destroy, the drillable tube. The crushed drillable tube '101 may block fluid flow from traversing through the solid plug.

Figure 4A:
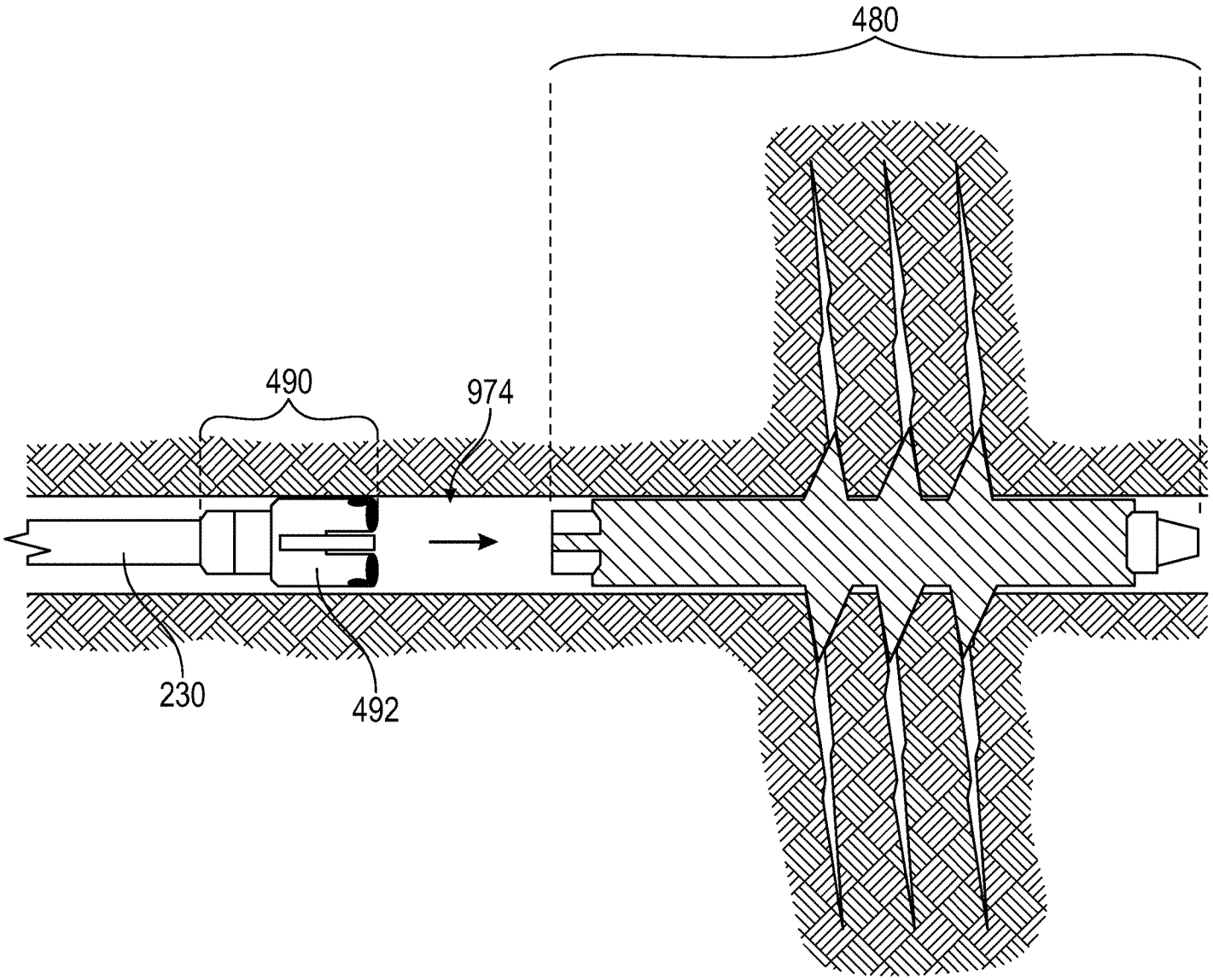
FIG. 4A shows preparation for drilling through the solid plug, per one or more embodiments.

FIG. 4A shows preparation for drilling through the solid plug that is readily drilled through. Solid plug 480 is affixed in wellbore 974. A drilling assembly 490 with a drill bit 492 is shown introduced (arrow) into the wellbore 974. The drilling assembly 490 is attached to drill pipe 230 and is positioned uphole of solid plug 480.

Figure 4B:
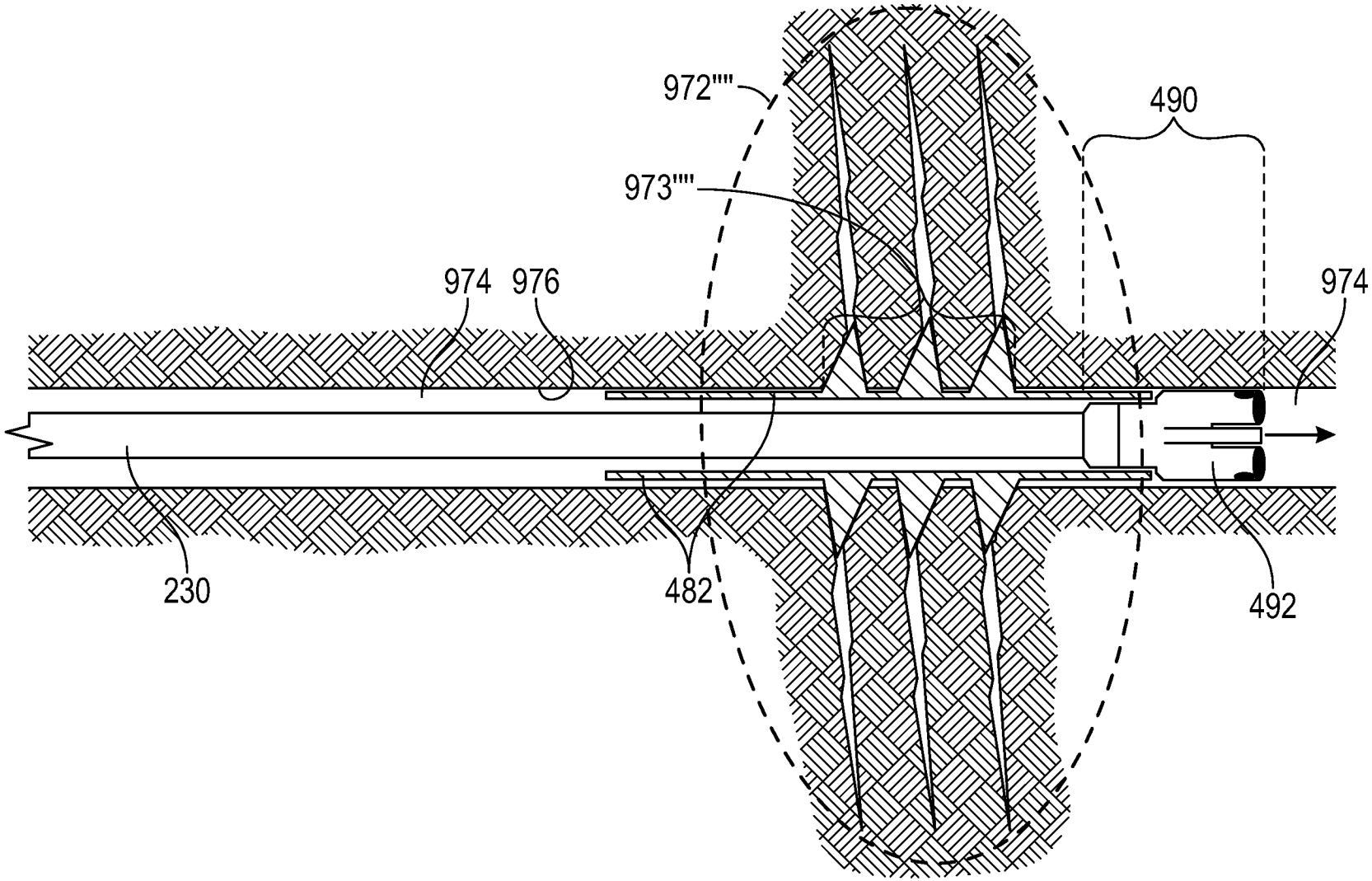
FIG. 4B shows the remainder of the solid plug isolating the lost circulation zone, per one or more embodiments.

FIG. 4B shows the remainder of the solid plug isolating the lost circulation zone from the wellbore. The drilling assembly 490 drills through the solid plug and traverses the remainder of the solid plug 482 to continue tripping downhole. Meaning, the drilling assembly 490 removes both the drillable tube and a majority of the hardened and fully expanded expandable layer from what was the solid plug 480 of FIG. 4A. The remainder of the solid plug 482 includes hardened expandable layer from the apparatus. The remainder of the solid plug 482 forms a configuration: a ring-like or a sleeve shaped seal. This configuration affixes to the wellbore wall 976 where the solid plug was located. The remainder of the solid plug 482 keeps the lost circulation zone sealed from fluids. This fluid seal includes the portion across the lost circulation zone face 973"" and within the lost circulation zone 972"".

In FIG. 4B, fluidic communication throughout the wellbore is re-established (and without fluidic communication between the wellbore and the lost circulation zone). After drilling through the solid plug and sealing the lost circulation zone, normal wellbore operations may resume. The remainder of the solid plug maintains the fluid seal between the wellbore and the lost circulation zone by sealing the face of the lost circulation zone. The remainder of the solid plug is configured to tolerate fluid and tool movement uphole and downhole without losing integrity.

Solid-State Lost Circulation Apparatus

One or more embodiments of the solid-state lost circulation apparatus includes a drillable tube, drillable couplings, an expandable layer, and an isolation layer. FIG. 1 shows an apparatus, as previously described. Further, FIGS. 2A to 2F and FIG. 3A show an apparatus introduced into and used in the wellbore to seal a lost circulation zone, as previously described.

In one or more embodiments, the apparatus includes one or more drillable material. Examples of drillable materials may include, but are not limited to, a fiber-based, a polymer-based, a resin-based, a metal-based, or a ceramic-based material, or a combination thereof. An example of a drillable material is fiberglass.

The drillable material is not particularly limited so long as the integrity of the apparatus is maintained and the apparatus functions as designed. The drillable material is drilled through with less force than when compared to drilling through the formation.

Tube Length

In one or more embodiments, the apparatus includes a drillable tube. The drillable tube has a physical configuration including, but not limited to, a tube longitudinal length, a proximate end, a distal end, a tube interior surface, a tube exterior diameter, and a tube wall width. In one or more embodiments, the longitudinal length of the drillable tube is less than the longitudinal length of the lost circulation zone.

The longitudinal length of the lost circulation zone may be determined by running a length of a line parallel to a centerline of the wellbore. The longitudinal length of the lost circulation zone may be measured from the uphole-most portion of the face of the lost circulation zone to the downhole-most portion of the face of the lost circulation zone. Other methods for determining the length of the lost circulation zone are known.

In one or more embodiments, the longitudinal length of the drillable tube may be shorter than, equal to, or longer than the longitudinal length of the lost circulation zone. In FIGS. 2A to 2F, the drillable tube shown is longer than the lost circulation zone. When the drillable tube is shorter than the longitudinal length of the lost circulation zone, multiple drillable tubes may be combined to increase an overall longitudinal length.

Tube Thickness

The drillable tube has an interior surface and an exterior surface along its longitudinal length. The distance between the interior and exterior surface is the tube thickness.

In one or more embodiments of the apparatus, the thickness of the drillable tube may be about the standard drill pipe thickness. The thickness of the drillable tube may depend on one or more factors, including, but not limited to, the material of construction of the drillable tube, the number of fluid ports through the drillable tube, the internal diameter of the drillable tube, and the wellbore conditions.

The drillable tube thickness is sufficient for the drillable tube to withstand wellbore conditions and transit conditions. Wellbore conditions may include, but are not limited to, fluid force, pressure, and temperature of the drilling environment. Transit conditions may include, but are not limited to, abrasion with solids in the wellbore fluid, torque from a rotating drill pipe, and collision with the wellbore wall.

Further, the drillable tube thickness is sufficient for the drillable tube to support the expansion of the expandable layer. When the expandable layer activates, expands, and hardens to form a solid plug, the drillable tube supports the expandable layer as it activates and expands. As the expanding expandable layer contacts the wellbore wall, the drillable tube may be crush by the force of the expanding expandable layer.

Tube Diameter

The drillable tube may have a cross-section that is circular or near-circular, such as elliptical. The diameter of the drilling tube may depend on one or more factors, including, but not limited to, the diameter of the wellbore, the curvature of the wellbore, the outward expansion distance of the expandable layer, the thickness of the isolation layer, and the desired annulus space between the apparatus and wellbore wall. In one or more embodiments, the configuration of the apparatus is such that it may operate in a wellbore having a casing or wellbore diameter up to and including 28 inches ("). The wellbore may have a greater diameter than 28".

Tube Surfaces

The interior surface of the drillable tube defines a void that is configured as a fluid conduit. Fluid may enter, traverse, and exit, the drillable tube through this conduit. The fluid conduit may act as part of the fluid flow pathway. An example of the fluid flow pathway is shown in FIG. 2C where a fluid flow path 232' flows through the empty space inside.

In addition, the fluid conduit may include an expandable layer as described in one or more embodiments.

Fluid Ports

In one or more embodiment apparatus, the drillable tube defines one or more fluid port through the tube thickness. The one or more fluid ports permits fluid flow between the interior and exterior of the drillable tube. The number, size, pattern, and shape, of the one or more fluid ports are not particularly limited so long as the mechanical integrity of the drillable tube is maintained for introduction and transport downhole to the lost circulation zone. As well, fluid flow from the interior of the drillable tube to its exterior is relatively unencumbered. For example, FIG. 1 shows circular-shaped fluid ports 108 in a regular pattern along the length of the drillable tube 101.

In one or more embodiments, the fluid ports may be provided on a portion or section of the drillable tube or along the full longitudinal and circumferential aspects of the tube. In one or more embodiments, the fluid ports may be present along the full circumference of the drillable tube but for a portion of the longitudinal length. In one or more embodiments, fluid ports may be present along the full longitudinal length of the drillable tube but for a portion of the circumference of the drillable tube. In one or more embodiments, the fluid ports may be provided along the full longitudinal length and around the circumference of the drillable tube. The size of the fluid ports may be any size while maintaining the integrity of the drillable tube.

Connectors

In one or more embodiments, the connector may be configured such that the connector may mate with an associated connector, such as in a male/female type coupling, to connect to another piece of downhole equipment. The connectors may be configured with internal or external pipe threads, press-fit, glued, or other forms of coupling or connection to affix the solid-state lost circulation apparatus to another downhole fitting. An example may be the associated connector on the end of a drill pipe, a drill collar, and a sub, such as a bypass tool or a second solid-state lost circulation apparatus.

In one or more embodiments of the apparatus, the connector may be configured such that fluid may flow through the interior of the connector and into or out of the apparatus. In one or more embodiments, the connector may be configured such that the connector is closed or sealed from fluid.

Expandable Layer—Coupled/Connected to Exterior Surface

In one or more embodiments, an expandable layer is coupled to the exterior surface of the drillable tube. In one or more embodiments of the apparatus, the expandable layer is connected to the exterior surface of the drillable tube. The expandable layer on the exterior portion of the drillable tube is configured to expand outward from the exterior surface of the drillable tube. FIG. 1 and the description supporting show an example of this relationship between the exterior surface of the drillable tube and the expandable layer for an apparatus.

Expandable Layer—External Physical Configuration and Surface Coverage

In one or more embodiments of the apparatus, the expandable layer may provide coverage over the full exterior surface of the drillable tube, such as shown in the apparatus of FIG. 1. For example, the external expandable layer may have the configuration that is like a sleeve that is coupled or connected to the drillable tube. In one or more embodiments, the expandable layer may cover the full exterior surface of the drillable tube. In one or more embodiments, the expandable layer may cover a portion of the exterior surface of the drillable tube. For example, an external expandable layer may cover an uphole portion of the drilling tube completely around the circumference of the exterior surface of the drillable tube. Another example, an external expandable layer may cover a portion of the circumference of the exterior surface for the longitudinal length of the drillable tube. Other potential configurations are envisioned as part of one or more embodiments of the apparatus, including multiple rings that cover a portion or the full drillable tube.

In instances where the expandable layer covers a portion of the exterior surface of the drillable tube and flow holes remain uncovered, these holes may be covered by the isolation layer.

Expandable Layer—External Physical Configuration—Shape

The physical configuration of the expandable layer may not be particularly limited. The expandable layer may have an exterior surface configuration that is solid and smooth, such as having a cylinder-like or other geometrical configuration. In one or more embodiments, the exterior physical configuration of the expandable layer may be such that upon expansion of the external layer of the expanded expandable layer may mimic the configuration of the wellbore wall. In effect, the exterior surface of the expanded expandable layer may be a molded replica of the physical configuration of the lost circulation zone and the wellbore wall.

Expandable Layer—External Physical Configuration—Internal Surface

In one or more embodiments of the apparatus, the configuration of the internal surface of the expandable layer facilitates activation agent distribution. The internal surface of the expandable layer is the surface that couples or contacts the exterior surface of the drillable tube. For example, the internal surface of the expandable layer may be configured such that there are corresponding voids in the expandable layer with the positions of the flow ports. For example, the expandable layer may have holes traversing a portion or the full expandable layer at the locations of the flow ports. This may increase the surface area exposure of the expandable layer to fluid contact when fluid is introduced to the expandable layer through the flow ports. Another example may include an internal surface configuration of the expandable layer that has flow channels in fluid communication between different fluid ports along the exterior surface of the drillable tube. The flow channels may run between the external surface of the drillable tube and the expandable layer. In other instances, the flow channels may run internally through the expandable layer itself. As another example, recesses and ridges that permit fluid flow of activation agent around the circumference or along the longitudinal length of the external surface of the drillable tube, or both, may permit contacting portions of the expandable layer without access to a flow port.

Expandable Layer—Coupled/Connected to Interior Surface

The fully expanded and hardened expandable material may occupy a portion of or the full void space within the interior of one or more embodiments of the apparatus.

Expandable Layer—Composition—Activation Agent

An expandable layer is configured to expand and harden upon exposure to an activation agent. In one or more embodiments, the activation agent for the expandable layer includes water. "Water" may include fresh and potable waters from surface sources (lakes, rivers, swamps), subterranean sources (aquifers), and synthetic sources (desalinization, boiler feed); synthetic and natural sea water; brackish water; synthetic or natural brines; formation water; production water; gray, black, blue, and brown waters; storm runoff; agricultural waste and runoff; chemical process water; reverse-osmosis retentate; mining slurries; and combinations thereof. Water that may act as an activation agent for the expandable layer may include aqueous solutions, emulsions, and dispersions that include water soluble materials, aqueous acids, aqueous bases, salts, water-soluble organics, and other chemical compounds that may be suspended, emulsified, or dissolved in water. The use of non-potable water as an activation agent may be useful to "upcycle" such liquids.

In a scenario where the drilling fluid is not water based, such as in shale, both the expandable layer (composition) and the activation agent may be changed to accommodate the scenario. That is, the expandable layer and the activation agent will be modified to perform as described, in other well bores that are known in the art.

Expandable Layer—Composition—Material

In one or more embodiments, the expandable layer composition includes a superabsorbent polymer. Without wanting to be bound by theory, the expandable layer physically absorbs activation agent into the composition. While doing so, the composition alters its chemical structure to accept hydrogen bonding and other chemical interactions with activation agent. As the chemical structure of the expandable layer is altered, the physical structure of the expandable layer changes (to expand). The superabsorbent polymer may absorb around 300 times its own weight and between about 30 to 60 its volume of activation agent. The absorption properties of the polymer may be effected by the pressure and temperature in the well and the composition of the expandable layer.

The material composition of the expandable layer may vary from one apparatus to the next, depending on the scenario. The density of the material composition is substantially constant throughout the expandable layer (before expansion). When more than one layer is included as the expandable layer, the different layers may react at different rates with the same activation agent. This may control or change the overall expansion rate of the expandable layer.

If the wellbore diameter is wider than an expandable distance of the expandable layer composition, then the expandable layer may include multiple sleeves. The multiple sleeves may compensate for larger size wellbores (and holes).

Isolation Layer—Coupled/Connected to Exterior Surface

In one or more embodiments, the isolation layer is coupled to the exterior surface of the expandable layer. In one or more embodiments of the apparatus, an isolation layer is connected to the exterior surface of the expandable layer. See FIG. 1 and description thereof.

Isolation Layer—External Physical Configuration—Coverage

In one or more embodiments of the apparatus, the isolation layer is configured to cover the full exterior surface of the expandable layer. In one or more embodiments of the apparatus, the expandable layer partially covers the exterior surface of the drillable tube. In one or more embodiments, the isolation layer may still couple or connect to the full exterior surface of the expandable layer and the drillable tube. In doing so, this may ensure that the expandable layer is chemically isolated and physically protected. In one or more embodiments of the apparatus, the isolation layer may couple or connect to the full exterior surface of the apparatus. This may include the exterior surfaces of the uphole and the downhole connectors. Such coverage of the exterior surfaces may provide additional physical and chemical protection to the remaining exterior surfaces of one or more embodiments of the apparatus.

Isolation Layer—Breakability Upon Expansion

The isolation layer on the exterior portion of the expandable layer is configured to be ruptured upon having a sufficient force introduced to it from an expanding expandable layer. In one or more embodiments, the isolation layer may rupture by decoupling or disconnecting from the exterior surface of the expanding expandable layer. In such an instance, the isolation layer may partially or completely break apart from the expanding expandable layer, falling away from the expandable layer and exposing the exterior surface of the expanding expandable layer. FIG. 2E and its description describe a similar effect where fragments of isolation layer float away from the expanding expandable layer. In one or more embodiments, the isolation layer may rupture by forming fractures, cracks, and voids, such that the exterior surface of the expanding expandable layer is exposed to the wellbore fluid. In one or more embodiments, the force of the expanding expandable layer may push aside portions of the ruptured isolation layer as the expandable layer continues to expand. Persons of ordinary skill in the art may appreciate that the isolation layer may be ruptured by the expanding expandable layer to expose the exterior surface in a combination and number of different ways.

Isolation Layer—Resistance to Wellbore Fluid

As previously described, the isolation layer for one or more embodiments of the apparatus is configured to resist the wellbore fluid. The chemical configuration of the isolation layer provides for resistance to the wellbore fluid; it is non-reactive. In this instance, "non-reactive" means that the isolation layer is chemically inert to an activation agent that may be found in the water-based drilling fluid. The isolation layer prevents activation agent to interact with another layer (such as the expandable layer) while intact. As the wellbore conditions change—as one or more embodiments of the apparatus is introduced from the surface and positioned adjacent to the lost circulation zone—the isolation layer adapts or accommodates to the changes. Such changes to the wellbore fluid may include, but are not limited to, changes to the composition, including the presence and concentration of gaseous, liquid, solid, and activation agent components; pH; pressure; fluid density; fluid circulation rate; and temperature.

In one or more embodiments of the apparatus, the isolation layer is non-reactive to a water-based drilling fluid. "Non-reactive with a water-based drilling fluid" means that the isolation layer does not react with the water-based drilling fluid or any of its components. Water is the same as previously defined.

Isolation Layer—Resistance to Activation Agent

In one or more embodiments of the apparatus, the isolation layer is non-reactive to the activation agent. "Non-reactive with the activation agent" means that the isolation layer does not react with the activation agent or any of its components including, but not limited to, the activation agent composition, a composition including the activation agent, and components of the activation agent. As previously described, the activation agent may comprise water.

Isolation Layer—Thickness

In one or more embodiments, the isolation layer may have a thickness in a micrometer range. For a particular coating thickness, a balance may be struck between the function of protecting and sealing the expandable layer from physical damage and exterior chemical interaction and the ease by which the expanding expandable layer may rupture the isolation layer and expand further into the wellbore. Too thick an isolation layer and the expanding expandable layer may lack the (expansion) force to rupture the isolation layer; too thin and the expandable layer is susceptible to physical damage or exterior chemical intrusion due to damage to the isolation layer. Further, the composition of the isolation layer may influence the thickness of the isolation layer.

Isolation Layer—Composition

The isolation layer of one or more embodiments of the apparatus comprises a coating. The coating prevents contact of the expandable layer with the fluid in the well. Thus, the coating composition remains intact in the presence of the well bore fluid. The composition is allowed to break with the expansion of the expandable layer. In one or more embodiments, the composition is a crosslinked thermoset polymer. In one or more embodiments, the composition is a polyacrylic.

In one or more embodiments, the polymer of the polymer coating comprises a hydrophobic polymer. A surface is "hydrophobic" when its static water contact angle $\theta$ is >90°. A hydrophobic polymer is insoluble in water or unable to be solvated by water.

Lost Circulation Assembly System—Purpose

One or more embodiments of the lost circulation assembly system comprises the solid-state lost circulation apparatus. An example is the system shown in FIG. 2A. One or more embodiments of the system is useful for traversing the wellbore and positioning the apparatus adjacent to the lost circulation zone. One or more embodiments of the system is also useful to control the direction and flow of fluids through the system, especially for selectively introducing a fluid comprising the activation agent into the interior of one or more embodiments of the apparatus.

Drill Pipe

One or more embodiments of the system may include one or more pieces of downhole drilling equipment that are useful for conveying the system and controlling the flow of fluids from the surface into the interior of the apparatus. One or more embodiments of the system may include a drill pipe, such as that represented in FIG. 2A. The drill pipe may include drill pipe that is traditionally used for drilling and completion operations; however, other types of drill pipe may be used. The length of the drill pipe is such that it permits positioning of one or more embodiments of the apparatus in the wellbore adjacent to the lost circulation zone.

In one or more embodiments of the system, the system consists essentially of or consists of drill pipe and the apparatus. One or more embodiments of the apparatus may be connected to the drill pipe. Activation agent may be introduced to one or more embodiments of the apparatus through the drill pipe without any additional equipment or subs.

Bypass Tool—Purpose

In one or more embodiments of the system, the system may include a bypass tool. FIG. 2A shows an embodiment system with a bypass tool connected to the drill pipe. The bypass tool is a sub that is configured to selectively direct fluid flow depending on its mode of operation. A bypass tool provides for selection of one or more fluid flow paths for the system. An example of a bypass tool includes a circulation sub.

Bypass Tool—Operations

The bypass tool is configured to permit the selective control of the fluid flow path, and the resultant fluid flow, through one or more embodiments of the system. In one or more embodiments of the system, the bypass tool may be switched between two or more modes of operation, such as a "closed" mode, a "bypass" mode, and an "open" mode. In one or more embodiments of the system, the bypass tool has three modes of operation. In one or more embodiments of the system, the bypass tool has two modes of operation: a "closed" mode and an "open" mode. In one or more embodiments, the bypass tool blocks fluid that may be introduced into the annular space of the wellbore.

Bypass Tool—Operation—Closed Mode

In a closed mode of operation, fluid flow is selectively permitted from progressing further downstring. No fluid may pass through the bypass tool. If there is no other opening in the system, then any fluid in the drill pipe is static.

Bypass Tool—Operation—Bypass Mode

When the bypass tool is in a bypass mode of operation, in one or more embodiments the fluid flow is selectively permitted to flow along a first fluid flow path. An example is shown in FIG. 2B, where the fluid flow path is through the drill pipe, into and out of the bypass tool, and into the annular space.

Bypass Tool—Operation—Open Mode

When the bypass tool is in an open mode of operation, fluid flowing downstring enters and exits the bypass tool along a second flow path. In one or more embodiments, when the bypass tool mode of operation is modified from a bypass mode to an open mode, a second fluid flow path is created. Through the second fluid flow path, the fluid may flow into the annular space and also into the interior of the apparatus. In one or more embodiments, when the mode of operation of the bypass tool is switched to an open mode, the second fluid flow path may direct the fluid flow into one or more embodiments of the apparatus; there may be no fluid selectively directed into the annular space.

Bypass Tool—Operation—Effect of Open Mode

Control over the direction of fluid entering the annular space may contribute to controlling of the amount of activation agent present in the annular space. As the expandable layer expands and breaks the isolation layer, any activation agent present in the annular space may contribute to further expansion and hardening of the expandable layer.

Introducing the Bypass Tool (Modifying Status)

One or more embodiments may be introduced into the wellbore where the bypass tool is in a closed mode. In one or more embodiments, the bypass tool may be introduced into the wellbore in a bypass mode.

Modifications to the mode of operation of the bypass tool may occur once an apparatus (of a system) is positioned adjacent the lost circulation zone. Modifying the mode of operation to the open mode, the bypass tool permits fluid flow to be introduced into a solid-state lost circulation apparatus. FIGS. 2B to 2C show the effect to the fluid flow path after modification to the mode of operation. A person of ordinary skill in the art has an appreciation of the methods for changing the mode of operation of a bypass tool, such as using mechanical, computer controller, acoustic signal, or electrical signal technologies. In one or more embodiments, the mode of operation may be modified using one or more ball that is dropped into the fluid flow. The bypass tool may be operated in open mode more than once.

Multiple Apparatus in a String

One or more embodiments of the system may comprise one or more embodiments of the solid-state lost circulation apparatus. An apparatus is coupled or connected to the other system components as part of a string of components such that a fluid flow pathway may by selectively formed and permit introduction of the activation agent to the interior of the apparatus.

Numbering for Discussion

For one or more embodiments of the system comprising more than one apparatus, the apparatuses and other system components may be coupled or connected such that a fluid conduit may exist between the more than one apparatus. For example, a drill string may comprise a first solid-state lost circulation apparatus downstring of a second solid-state lost circulation apparatus. In one or more embodiments of the system, the first apparatus is coupled to the second apparatus. In one or more embodiments, the first apparatus is connected to the second apparatus.

Multiple Solid State Lost Circulation Apparatus—Intermediate Bypass Tool

In one or more embodiments of the system having a first apparatus and second apparatus, a bypass tool may be coupled or connected in between the first apparatus and the second apparatus. Such a bypass tool may be useful for controlling the fluid flow between the first apparatus and the second apparatus, such as to permit different activations at different periods and positions within the wellbore.

Multiple Solid State Lost Circulation Apparatus—Multiple Activation Agents

In one or more embodiments of the systems, a first apparatus and a second apparatus may be activated by a different activation agent. In such a system, the first apparatus may be activated by a first activation agent; the second apparatus may be activated by a second activation agent. This may allow for selective activation depending on position and longitudinal length of the lost circulation zone. Such a configuration may also prevent accidental activation of an apparatus when another apparatus is positioned to remediate a lost circulation zone.

Multiple Solid State Lost Circulation—Multiple Configuration

When a system includes more than one apparatuses, the configuration of one apparatus may vary from another apparatus. For example, one apparatus may have different dimensions for the drillable tube from another apparatus, including, but not limited to, longitudinal length, tube diameter, and tube thickness. Other configuration aspects may vary, including differences to the expandable layer and the isolation layer.

Generic String Statement

Other common drilling and downhole tools, including, but not limited to, various kinds of drill pipe, drill collars, fluid bypass tools, wall reamers, whipstocks and downhole pumps, may be included. These common drilling and downhole tools that may be included allow the purpose of the one or more embodiment systems to be achieved. A person of ordinary skill will appreciate any additional optional components that may be included in such a configuration.

Method of Mitigation of a Lost Circulation Zone

Figure 5:
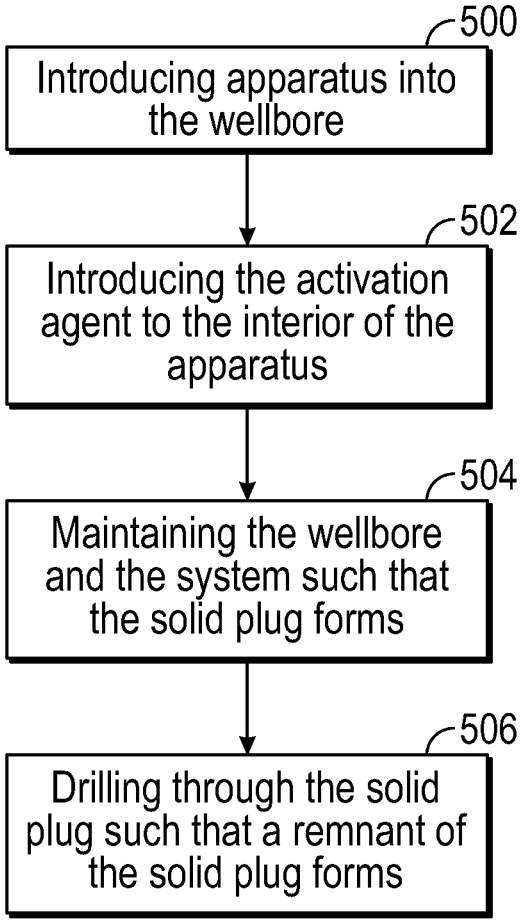
FIG. 5 details the method of use of apparatus and system, per one or more embodiments.

Methods according to one or more embodiments are outlined in FIG. 5. The methods include mitigating a lost circulation zone by introducing one or more embodiments of solid-state lost circulation apparatus into a wellbore 500. The methods may include introducing the activation agent to the interior of the apparatus 502. The methods may include maintaining the wellbore and the system such that the solid plug forms 504. The methods may include drilling through the solid plug such that a remnant of the solid plug forms 506.

One or more embodiments of the apparatus is introduced as part of a lost circulation assembly system. For example, the method may include a system with drill pipe, a bypass tool, and an apparatus as shown in FIG. 2A.

During the introduction into the wellbore, one or more embodiments of the apparatus may be positioned such that it is adjacent to the lost circulation zone. The system is positioned such that the resultant solid plug covers and seals a portion of or the full extent of the face of the lost circulation zone.

Where the solid plug covers part of the lost circulation zone, the method may be repeated with a second apparatus as part of a second system (by repeating the method) to cover and seal the remaining portion of the unsealed face of the lost circulation zone.

Alternatively, where one or more embodiments of apparatus has a longitudinal length that is less than the longitudinal length of the face of the lost circulation zone, the system may include a first apparatus and second apparatus coupled or connected in series. Such a system may be positioned such that the combination of activating both the first and the second apparatus may be used to cover and seal the face of the lost circulation zone, and in combination may mitigate the lost circulation zone.

In one or more embodiments of the system, if a bypass tool is present upstring of the apparatus, then the bypass tool may be introduced into the wellbore in a closed mode of operation. In one or more embodiments, the mode of operation of the bypass tool may be modified such that the bypass tool routes the fluid flow into the annulus of the wellbore, such as previously described, by changing the mode of operation of the bypass tool from closed to bypass. In one or more embodiments, activation agent may be distributed into the annular space of the wellbore before activation of the apparatus as described in FIG. 5, 502.

In one or more embodiments of the system, if a bypass tool is present upstring of the apparatus, then the bypass tool maybe introduced into the wellbore in a bypass mode of operation. In this instance, fluid may be directed to flow from the system into the annular space. In one or more embodiments, activation agent may be distributed into the annular space of the wellbore before activation of an apparatus. For example, the system as presented in FIG. 2B may have been introduced in such a mode of operation.

In one or more embodiments, the system may operate with or without a bypass tool as designed. In one or more embodiments, the apparatus may have a configuration to permit fluid to flow into the wellbore. In one or more embodiments of the apparatus, the downhole connector may be opened to permit fluid flow from the interior of an apparatus into the wellbore. In one or more embodiments, a portion of the fluid ports remain uncovered by the expandable layer to permit fluid flow from the interior of an apparatus into the wellbore. Such apparatus configurations may be useful to support wellbore circulation and treatment of the wellbore before activation of an apparatus. Regardless of the system configuration, during introduction of one or more embodiments of the apparatus into the wellbore, no activation agent flows into the interior of the apparatus.

In one or more embodiments, the activation agent is present in the wellbore before introduction of an apparatus into the wellbore. In one or more embodiments, the activation agent is a component of the drilling fluid. In one or more embodiments, the activation agent may be naturally occurring.

In one or more embodiments, the activation agent is introduced into the wellbore such that the activation agent is present in the annular space of wellbore between the apparatus and the lost circulation zone. For example, the activation agent may be introduced into the annular space using circulation of the wellbore fluid from the surface. The action agent may be introduced using another means, such as coiled tubing or another drill pipe.

One or more embodiments include introducing an activation agent into an interior of the solid-state lost circulation apparatus such that an expandable layer on the exterior surface of a drillable tube of the apparatus is activated. The activation agent is introduced into the lost circulation assembly system such that activation of the expandable layer occurs. Activation of an expandable layer of a system is shown in FIG. 2C.

In one or more embodiments, the activation agent is introduced into the interior of the apparatus directly from the surface. In such a system, one or more embodiments of the apparatus may be coupled to or connected to a drill pipe through which the activation agent is introduced. In these instances, a lost circulation assembly system may comprise a drill pipe and a lost circulation apparatus coupled downstring of the drill pipe.

In one or more embodiments, the activation agent is introduced into the apparatus from the wellbore. In one or more embodiments, wellbore fluid may be drawn into the apparatus from an open distal end of the drillable tube or a downhole connector. In one or more embodiments, wellbore fluid may be drawn into the interior of the apparatus from one or more flow ports that remain uncovered by the expandable layer. Wellbore fluid circulated uphole through the system and pumped downhole through the annulus may facilitate such interaction.

In one or more embodiments, the mode of the bypass tool is changed from closed to open to permit the selective introduction of activation agent into the interior of the apparatus. In one or more embodiments, the mode of the bypass tool is changed from bypass to open to permit the selective introduction of activation agent into the interior of the apparatus. Techniques of changing the mode of operation of a bypass tool are known to a person of skill in the art.

When the activation agent is introduced into an apparatus, the activation agent contacts and interacts with the expandable layer of the apparatus. The apparatus is configured such that the activation agent flows through the interior (conduit) of the drillable tube and out of the fluid ports (those ports associated with the expandable layer). When the activation agent interacts with the expandable layer, the expandable layer activates, forming the activated expandable layer that begins to expand and form into the expanding expandable layer.

One or more embodiments include maintaining wellbore conditions and the system such that the expandable layer expands and hardens to form part of a solid plug (as outlined in 504 of FIG. 5), where the solid plug is positioned adjacent to the lost circulation zone and provides a fluid-tight seal across a face of the lost circulation zone such that the lost circulation zone and the wellbore are no longer in fluidic communication.

Maintaining a wellbore may include one or more affirmative action, such as increasing, maintaining, or decreasing the circulation rate of the wellbore fluid; increasing, maintaining, or decreasing pressure or temperature on the wellbore; modifying or maintaining the wellbore fluid weight of the wellbore fluid; maintaining, removing or introducing wellbore tools; and other such actions that are well known and understood to one of ordinary skill in the art during the period of expansion and hardening of the expanding expandable layer and the sealing of the face of the lost circulation zone. Even though actions may be taken in and through the wellbore, the wellbore is maintained at conditions that allow the formation of the solid plug.

The method may include monitoring fluid losses. Once the expansion takes place, the lost circulation zone is sealed, thereby preventing any more losses.

The method may include monitoring pressure. The well bore pressure will increase when the lost circulation zone is sealed.

As the interaction between the activation agent and the expandable layer continues, the expanding expandable layer may take in fluid from the wellbore and swell. This intake in fluid, whether in facilitating in a reaction or in a swelling process, causes the expanding expandable layer to increase in volume. With the increasing volume, the exterior surface of the expanding expandable layer exerts a force against the interior surface of the isolation layer.

After an adequate amount of force is applied by the expanding expandable layer to the isolation layer, the isolation layer ruptures. After rupturing the isolation layer, the expanding expandable layer is exposed to the fluid present in the annular space of the wellbore. Fluid in the annular space may further include activation agent. The expanding expandable layer may expand inside the drillable tube (though the flow ports), outside the drillable tube, or both. The now ruptured isolation layer may break partially or break completely off of the drillable tube. Such resultant product (a broken or removed isolation layer) may be released into the annular space; it is relatively harmless to rotating equipment and the wellbore. After being freed from the isolation layer, the expanding expandable layer is operable to expand into the annular space of the wellbore.

As the expanding expandable layer continues to expand, it may contact the wellbore wall and the face of the lost circulation zone. The expandable layer may take the shape of the wellbore proximate to the lost circulation zone. An example of such configuration is shown in FIG. 2F. "Taking the shape" of the wellbore means that the expanding expandable layer adopts an expanded state against and, in some instances, within the face of the lost circulation zone, forming a fluid-tight seal. The shape of the exterior (outward) surface of the hardened and expanded expandable layer may be viewed as a molded replica or impression of the face of the lost circulation zone. The molded replica or impression of the surface of the wellbore wall may be formed such that the material surfaces mate to prevent or significantly hinder fluid flow in between the surfaces. Also, the expanding expandable layer also contacts and forms a fluid-tight seal with the wellbore wall surrounding the face of the lost circulation zone. In some instances, this fluid-tight seal is based on chemical adhesion of the expanding expandable layer and the wellbore wall surface.

During or after the period of expansion has completed, whether all of the activation agent is exhausted or whether the expanding expandable layer has no further capability to absorb activation agent, the expanded expandable layer hardens. Hardening (also known as curing) forms a hardened and expanded expandable layer that maintains the seal against the face of the lost circulation zone and the wellbore wall adjacent to the face.

Upon formation of the hardened and expanded expandable layer, in conjunction with the drillable tube, the solid plug is formed. Again, as reference, FIG. 3A shows a solid plug. FIGS. 3B to 3E show versions of the solid plug using a wellbore centerline view.

In one or more embodiments, the solid plug fluidly isolates a downhole portion of a wellbore from an uphole portion of the wellbore. In such instances, a solid plug such as shown in FIGS. 3A, 3B, 3D, and 3E may be present, which include a hardened and expanded expandable material from the exterior of the drillable tube sealing the interior of the drillable tube, a closed or sealed distal end of the drillable tube, a second hardened and expanded expandable material dedicated to sealing the interior of the drillable tube, and a collapsed or crushed drillable tube where the drillable tube has been "back collapsed" by the force of the expanding expandable material, respectively.

In one or more embodiments, the solid plug permits fluidic communication between a downhole portion of a wellbore from an uphole portion of the wellbore. For example, in FIG. 3C, a solid plug is shown with an open distal end. This configuration of a solid plug would permit fluid flow to pass from the uphole portion of the wellbore to the downhole portion of the wellbore, and vice versa. In this instance, the solid plug may also permit the traversal through the drillable tube of small tools and coiled tubing into the downhole portion of the wellbore.

One instance where creation of a solid plug permits fluidic communication with a downhole portion of the wellbore may be useful is if there may be a second (or more) lost circulation zone suspected or the lost circulation zone may be larger than expected. If there is a second (or more) lost circulation zone, or if the face of the lost circulation zone extends beyond the coverage of the solid plug downhole, it is believed that fluid would flow through the drillable tube from the uphole portion of the wellbore into the downhole portion of the wellbore. A fluid flow effect may also be observed if the portion of the face of the lost circulation zone or a second (or more) lost circulation zone is present uphole of the solid plug—fluid would not flow through the drillable tube of the solid plug. Both situations are potentially detectable at the solid plug.

In one or more embodiments, the method may include separating portions of a system from the sold plug. Separating may include one or more of cutting, torqueing, pulling, breaking, "twisting off", detaching, or otherwise disconnecting or decoupling, the drill string from the solid plug. An example is shown in FIG. 3A. Doing so may permit abandonment of the solid plug in the wellbore as the remainder of the system is tripped out of the wellbore. Even after decoupling the solid plug, the lost circulation zone remains sealed. As previously described, separation of the solid plug from the system does eliminate the system: the drill pipe and any additional subs are decoupled from the solid plug, which comprises the drillable tube and the resultant of the expandable layer.

Accessing Downhole—Alternative

After separating the drill string upstring of the plug, to continue drilling downhole or to access the wellbore downhole of the solid plug, the solid plug may be bypassed or in part removed from the wellbore. To prevent a reopening the lost circulation zone, tools, in some instance, may be routed through the open-ended drillable tube (as shown in FIG. 3C) to downhole of the solid plug. If the drillable tube has a broad enough diameter, tools and other downhole equipment may feasibly pass through the solid plug using the drillable tube as a conduit between the wellbore uphole of the solid plug and the wellbore downhole of the solid plug.

Drilling Out Plug

One or more embodiments include drilling through a solid plug such that a remnant of the solid plug is positioned adjacent to the lost circulation zone (as outlined in 506 of FIG. 5). The remnant provides a fluid-tight seal across a face of the lost circulation zone. The remnant is configured in a ring-like or a sleeve shaped seal depending upon how the solid plug remnant is drilled out.

In one or more embodiments of the method, the solid plug is partially drilled out to remove the center portion of the plug. For example, FIG. 4A shows the introduction of a drill bit uphole of a solid plug, and in FIG. 4B, the drill bit has completed drilling out the solid plug. The purpose of drilling through the solid plug is to re-establish mechanical access and fluidic communication between portions of the wellbore previously isolated by the solid plug, as well as to leave a remnant of the solid plug to continue mitigation of the lost circulation zone. The debris from drilling out the solid plug may fall to the bottom of the wellbore, such as in a rat hole, or may be circulated upwards and collected in the mud filtration system, depending on the relative buoyancy of the materials and viscosity and flow rate of the drilling fluid. Because the materials are drillable, common drill bits, for example, ones comprised of polycrystalline diamond compact, remain functional when transforming the solid plug into the remnant.

Plug Remnant

The remnant of the solid plug, previously described as possibly ring-like or sleeve shaped apparatus, is comprised of hardened and expanded expandable layer. An example of what the remnant may look like is shown as part of FIG. 4B. The remnant of the solid plug maintains the fluid-tight seal over the face of the lost circulation zone. Because of the hardness of the expanded expandable layer and the differential pressure between the wellbore and the lost circulation zone (and possible adhesion to the wellbore wall and formation inside the face), the remnant remains fixed in position. When drilling and completion activities are occurring, the remnant continues sealing the lost circulation zone from the wellbore in the presence of fluid and tool movement.

Unless defined otherwise, all technical and scientific terms used have the same meaning as commonly understood by one of ordinary skill in the art to which these systems, apparatuses, methods, processes, and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

The term "substantially" as used refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Ranges may be expressed as from about one particular value to about another particular value, inclusive. When such a range is expressed, it should be understood that another embodiment is from the one particular value to the other particular value, along with all particular values and combinations thereof within the range.

Although only a few example embodiments have been described in detail, those skilled in the art will readily appreciate that many modifications are possible in the example embodiments without materially departing from this disclosure. All modifications of one or more disclosed embodiments are intended to be included within the scope of this disclosure as defined in the following claims. In the claims, means-plus-function clauses are intended to cover the structures previously described as performing the recited function, not limited to structural equivalents, but also equivalent structures. It is the express intention of the applicant not to invoke 35 U.S.C. § 112(f) for any limitations of any of the claims, except for those in which the claim expressly uses the words 'means for' together with an associated function.

While one or more embodiments of the present disclosure have been described with respect to a limited number of embodiments, those skilled in the art, having benefit of this disclosure, will appreciate that other embodiments can be devised, which do not depart from the scope of the disclosure. Accordingly, the scope of the disclosure should be limited only by the attached claims.

What is claimed:

1. A solid-state lost circulation apparatus, comprising:

a drillable tube comprising a drillable material configured with an interior surface, an exterior surface, a distal end, a proximal end, and a longitudinal length along which one or more fluid ports through the drillable tube are defined;

an expandable layer comprising an expandable material that is a drillable material, coupling to the exterior surface of the drillable tube for at least a portion of the longitudinal length, having an interior surface and an exterior surface, and configured such that upon introduction to an activation agent the expandable layer activates, expands, and hardens into a hardened and expanded expandable layer; and an isolation layer comprising a material that is non-reactive to the activation agent and that is a drillable material, having an interior surface and an exterior surface, coupling to the exterior surface of the expandable layer such that the exterior surface of the expandable layer is physically and chemically isolated from introduction to the activation agent, and configured to rupture upon a sufficient force being introduced to the interior surface by an expanding expandable layer.

2. The apparatus of claim 1, where the activation agent includes water.

3. The apparatus of claim 1, where the isolation layer is non-reactive to a water-based drilling fluid.

4. The apparatus of claim 1 further comprising a downhole connector coupled to the distal end of the drillable tube and that is sealed to prevent fluid flow through the downhole connector from the drillable tube.

* * * * *